US007418822B2

(12) United States Patent
Perry

(10) Patent No.: US 7,418,822 B2
(45) Date of Patent: Sep. 2, 2008

(54) METHOD AND SUBSTANCE FOR REFRIGERATED NATURAL GAS TRANSPORT

(75) Inventor: Glen F. Perry, Pender Island (CA)

(73) Assignee: Zedgas Inc., British Columbia (CA)

( * ) Notice: Subject to any disclaimer, the term of this patent is extended or adjusted under 35 U.S.C. 154(b) by 0 days.

(21) Appl. No.: 11/437,083

(22) Filed: May 19, 2006

(65) Prior Publication Data

US 2006/0207264 A1 Sep. 21, 2006

(51) Int. Cl.
*F17C 11/00* (2006.01)
*F17C 5/00* (2006.01)

(52) U.S. Cl. ..... 62/46.1; 62/53.2

(58) Field of Classification Search ..... 62/46.1, 62/53.2, 54.1
See application file for complete search history.

(56) References Cited

U.S. PATENT DOCUMENTS

| | | | | |
|---|---|---|---|---|
| 3,232,725 | A * | 2/1966 | Secord et al. | 48/190 |
| 3,298,805 | A | 1/1967 | Secord et al. | |
| 3,389,714 | A | 6/1968 | Hughes et al. | |
| 3,407,613 | A | 10/1968 | Muller et al. | |
| 3,848,427 | A | 11/1974 | Loofbourow | |
| 4,010,622 | A | 3/1977 | Etter | |
| 5,315,054 | A | 5/1994 | Teel | |
| 5,900,515 | A | 5/1999 | Mallinson et al. | |
| 6,108,967 | A | 8/2000 | Erickson | |
| 6,111,154 | A | 8/2000 | Mallinson et al. | |
| 6,217,626 | B1 | 4/2001 | Morris et al. | |
| 6,584,781 | B2 * | 7/2003 | Bishop et al. | 62/54.1 |

FOREIGN PATENT DOCUMENTS

| | | | |
|---|---|---|---|
| FR | 1444669 | A | 5/1966 |
| FR | 1599721 | A | 7/1970 |
| GB | 1002491 | A | 8/1965 |
| WO | WO 98/53031 | A | 11/1998 |
| WO | WO 00/09851 | A | 2/2000 |

* cited by examiner

*Primary Examiner*—William C Doerrler
(74) *Attorney, Agent, or Firm*—MacPherson Kwok Chen & Heid LLP

(57) ABSTRACT

This invention relates to the storage under pressure in a container and subsequent transport of the filled pressurized container of particular natural gas or natural gas-like mixtures that contain methane or natural gas plus an additive, and which mixtures have been refrigerated to less than ambient temperature. (This invention also relates to a similar mixture which has been created by the removal of methane or a lean gas from a richer natural gas mixture.)

6 Claims, 15 Drawing Sheets

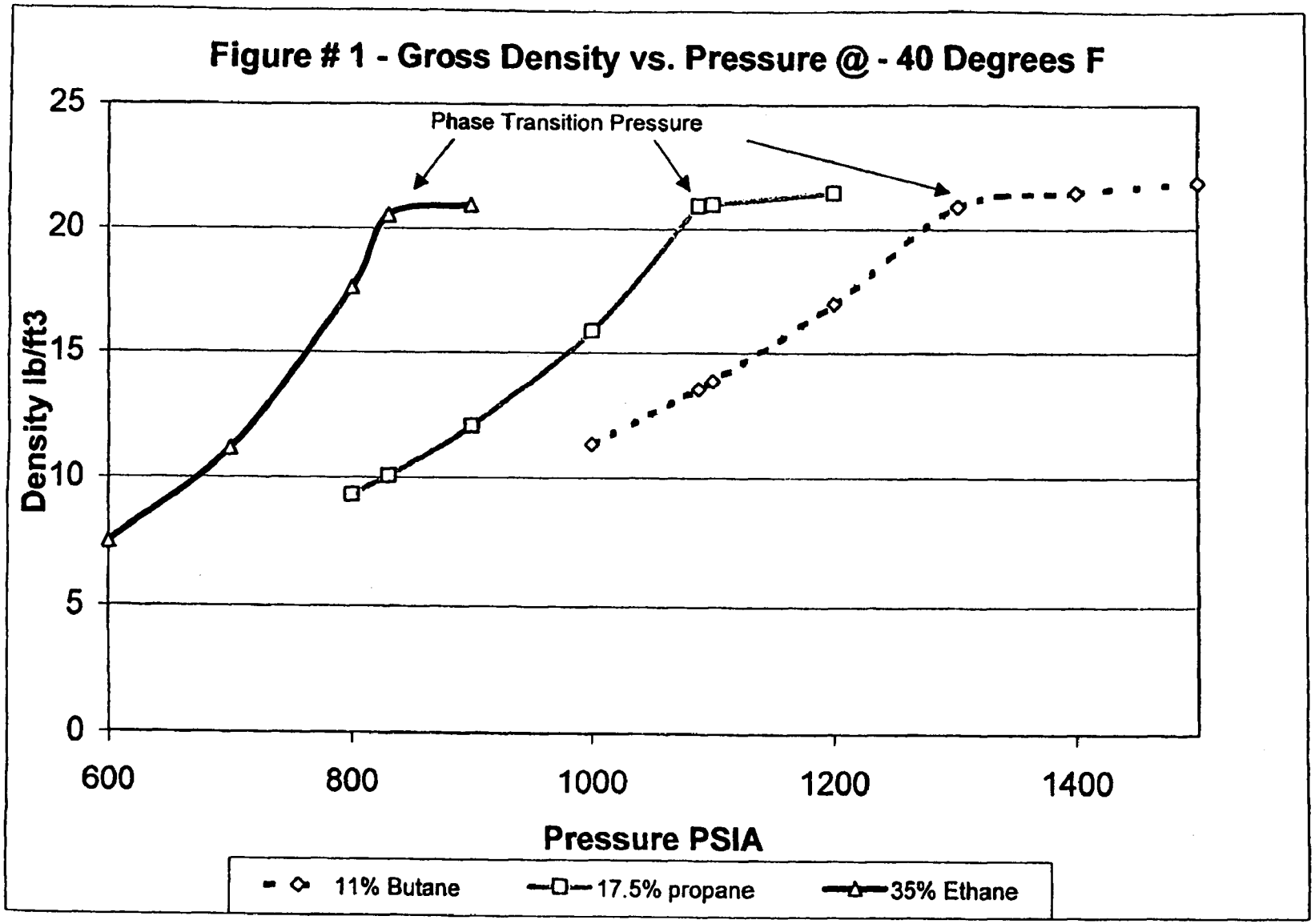
Figure # 1 - Gross Density vs. Pressure @ - 40 Degrees F
Phase Transition Pressure
Density lb/ft3
25
20
15
10
5
0
600
800
1000
1200
1400
Pressure PSIA
11% Butane
17.5% propane
35% Ethane

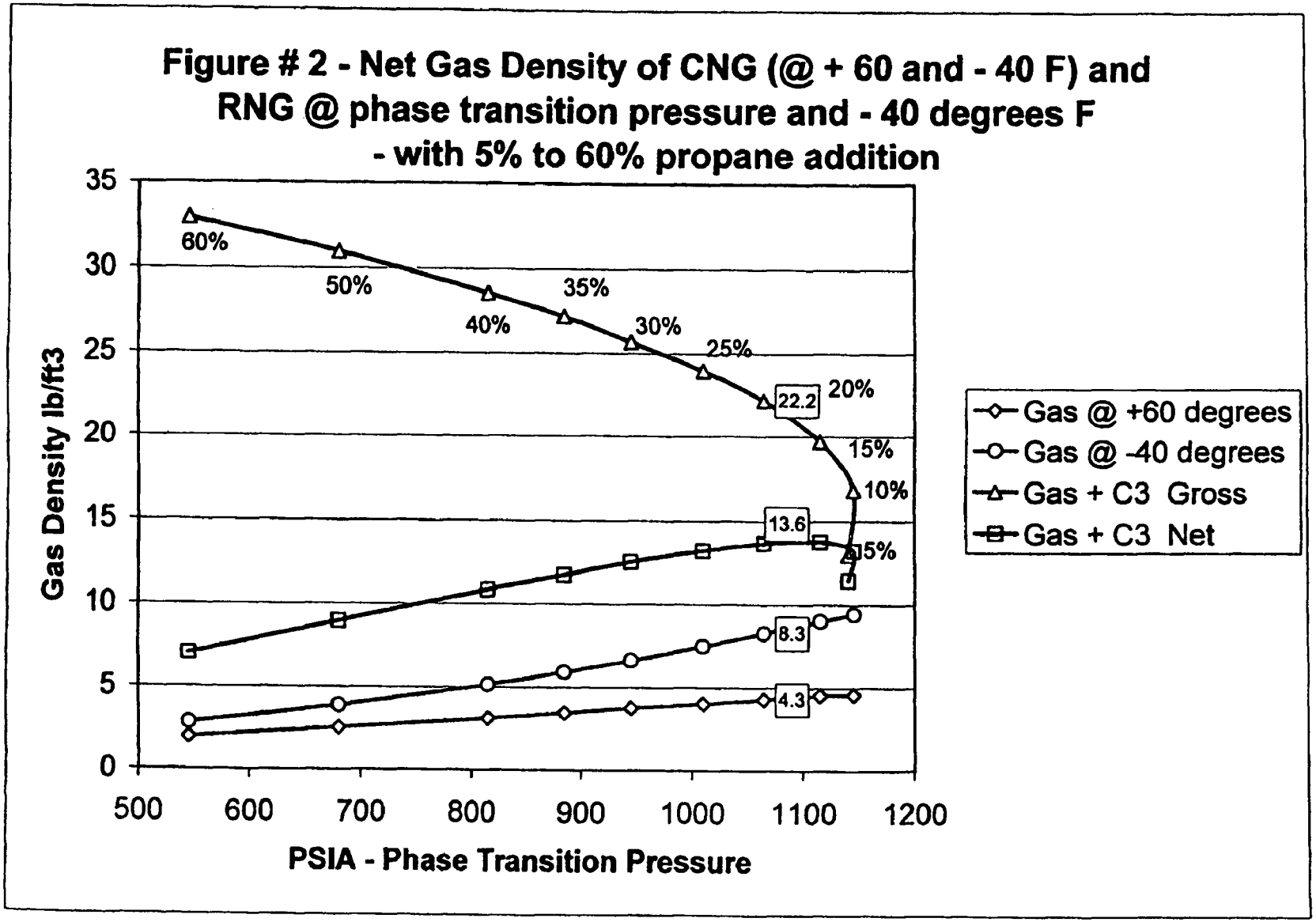
Figure # 2 - Net Gas Density of CNG (@ + 60 and - 40 F) and RNG @ phase transition pressure and - 40 degrees F - with 5% to 60% propane addition
Gas @ +60 degrees
Gas @ -40 degrees
Gas + C3 Gross
Gas + C3 Net
60%
50%
40%
35%
30%
25%
20%
15%
10%
5%
22.2
13.6
8.3
4.3
Gas Density lb/ft3
0
5
10
15
20
25
30
35
PSIA - Phase Transition Pressure
500
600
700
800
900
1000
1100
1200

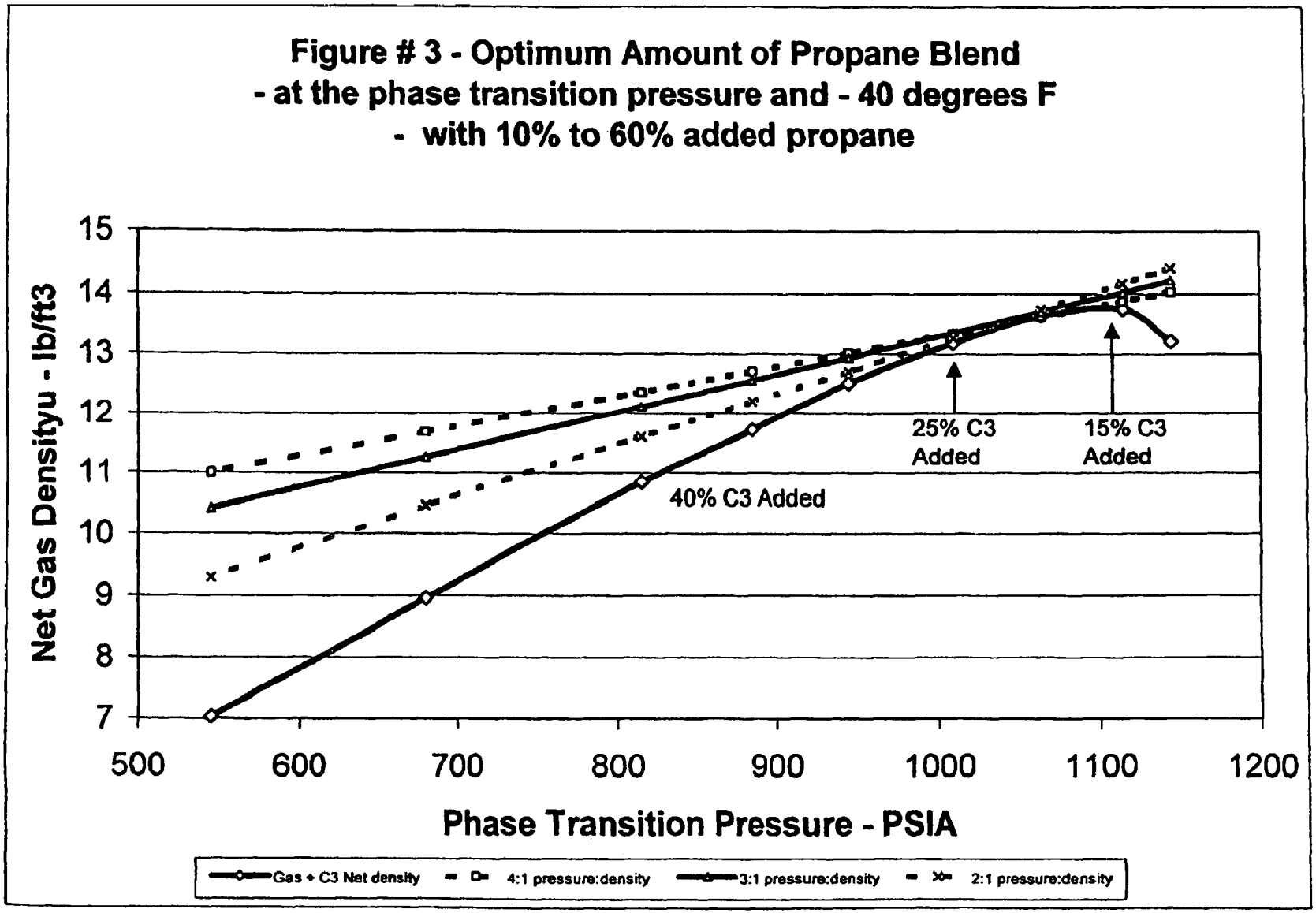
Figure # 3 - Optimum Amount of Propane Blend
- at the phase transition pressure and - 40 degrees F
- with 10% to 60% added propane
Net Gas Density - lb/ft3
15
14
13
12
11
10
9
8
7
500
600
700
800
900
1000
1100
1200
Phase Transition Pressure - PSIA
25% C3 Added
15% C3 Added
40% C3 Added
Gas + C3 Net density
4:1 pressure:density
3:1 pressure:density
2:1 pressure:density

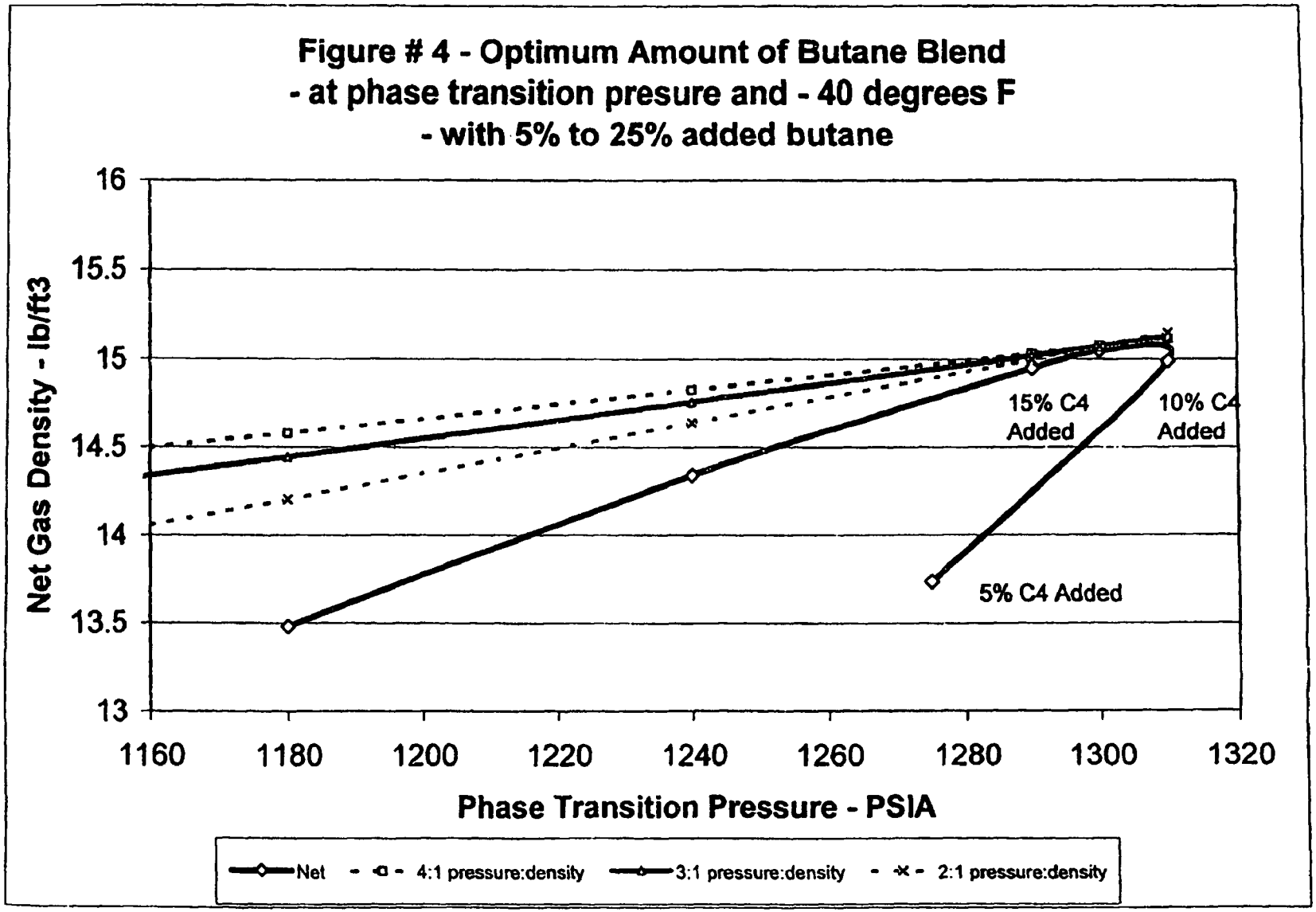
Figure # 4 - Optimum Amount of Butane Blend
- at phase transition presure and - 40 degrees F
- with 5% to 25% added butane
Net Gas Density - lb/ft3
16
15.5
15
14.5
14
13.5
13
1160
1180
1200
1220
1240
1260
1280
1300
1320
Phase Transition Pressure - PSIA
10% C4 Added
15% C4 Added
5% C4 Added
Net
4:1 pressure:density
3:1 pressure:density
2:1 pressure:density

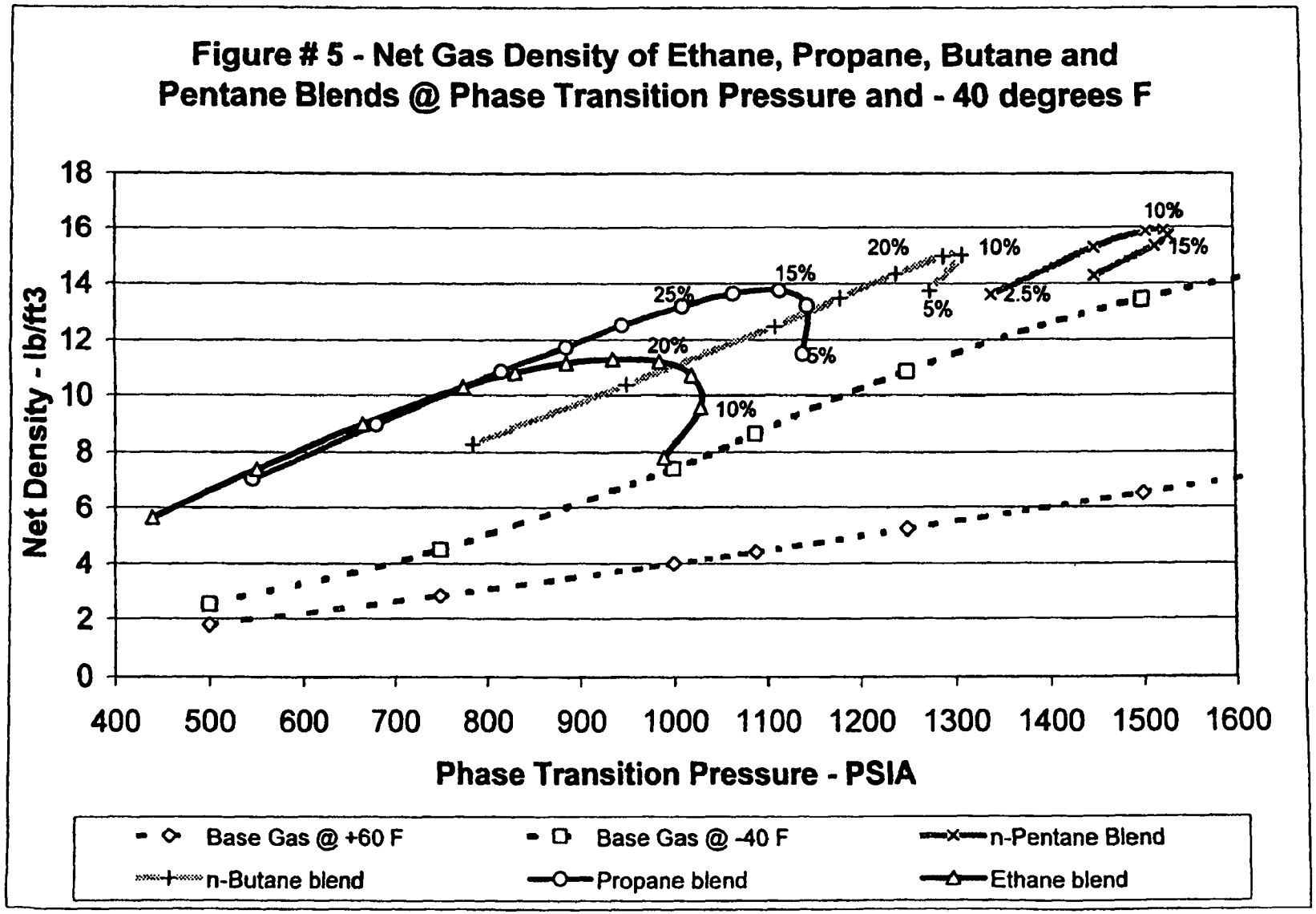
Figure # 5 - Net Gas Density of Ethane, Propane, Butane and Pentane Blends @ Phase Transition Pressure and - 40 degrees F
Net Density - lb/ft3
Phase Transition Pressure - PSIA
0
2
4
6
8
10
12
14
16
18
400
500
600
700
800
900
1000
1100
1200
1300
1400
1500
1600
10%
15%
2.5%
10%
5%
20%
15%
5%
25%
20%
10%
Base Gas @ +60 F
Base Gas @ -40 F
n-Pentane Blend
n-Butane blend
Propane blend
Ethane blend

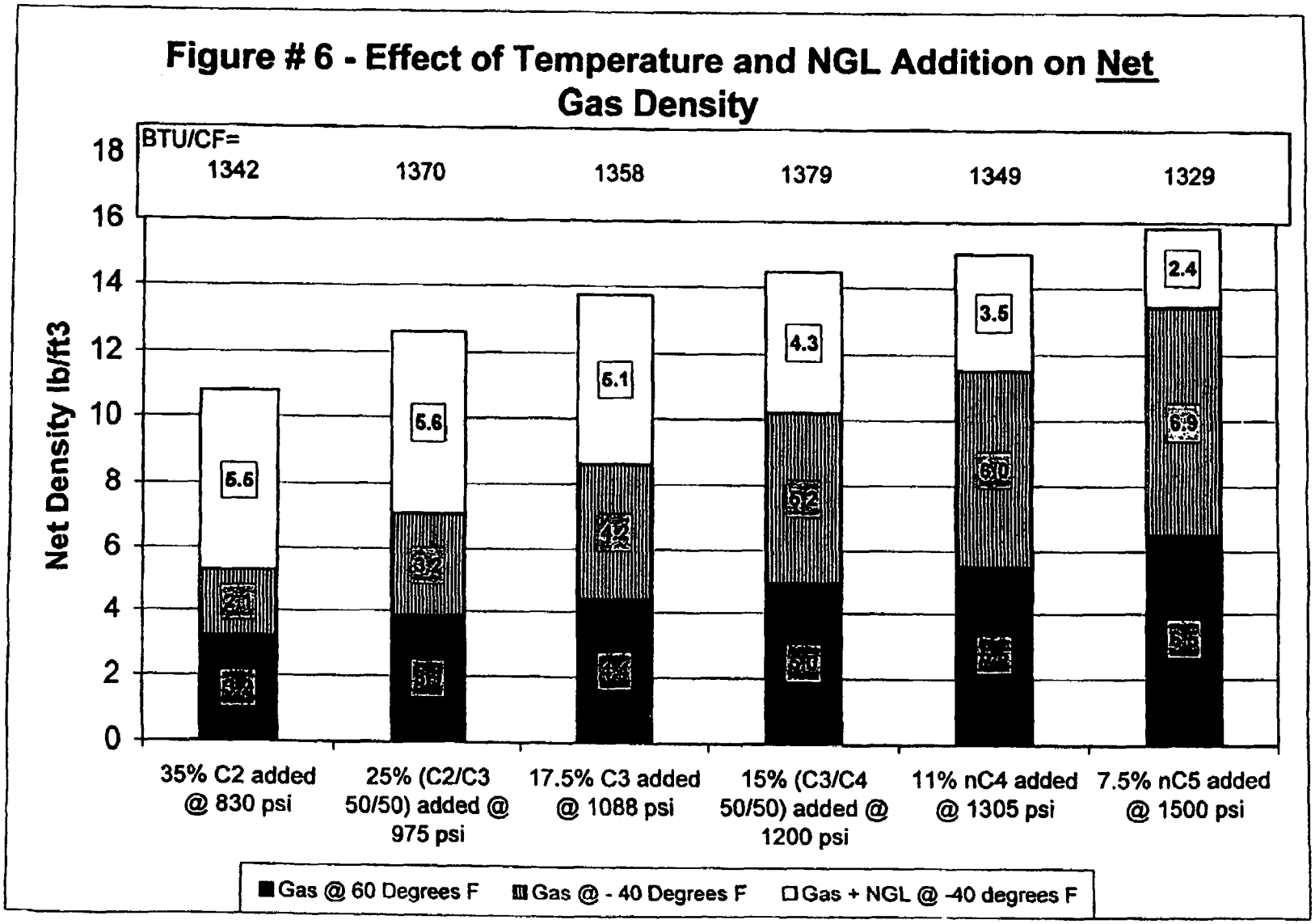
Figure # 6 - Effect of Temperature and NGL Addition on Net Gas Density
BTU/CF=
1342
1370
1358
1379
1349
1329
Net Density lb/ft3
18
16
14
12
10
8
6
4
2
0
5.6
5.6
5.1
4.3
3.5
2.4
35% C2 added @ 830 psi
25% (C2/C3 50/50) added @ 975 psi
17.5% C3 added @ 1088 psi
15% (C3/C4 50/50) added @ 1200 psi
11% nC4 added @ 1305 psi
7.5% nC5 added @ 1500 psi
Gas @ 60 Degrees F
Gas @ - 40 Degrees F
Gas + NGL @ -40 degrees F

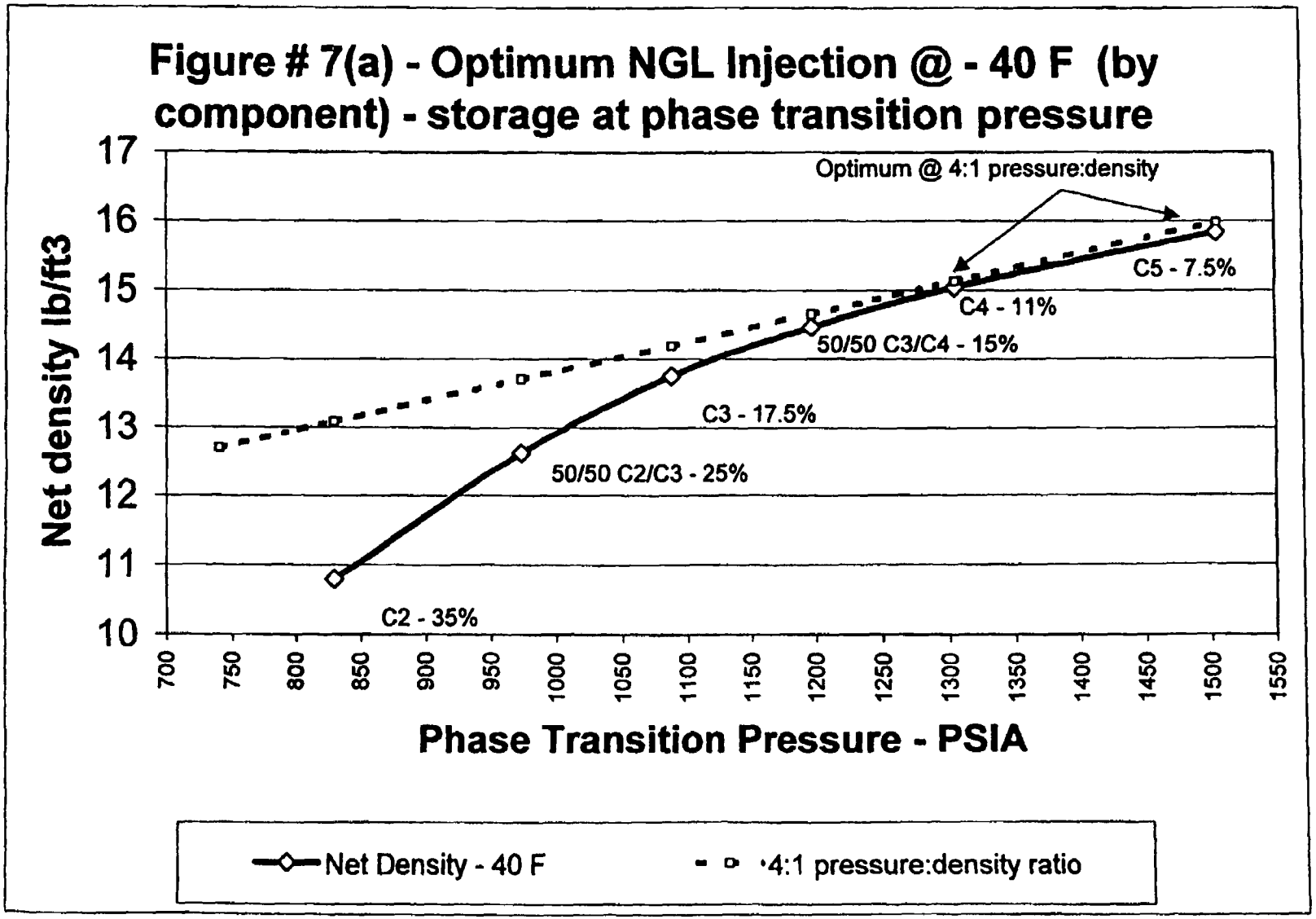
Figure # 7(a) - Optimum NGL Injection @ - 40 F (by component) - storage at phase transition pressure
Optimum @ 4:1 pressure:density
C5 - 7.5%
C4 - 11%
50/50 C3/C4 - 15%
C3 - 17.5%
50/50 C2/C3 - 25%
C2 - 35%
Net density lb/ft3
17
16
15
14
13
12
11
10
700
750
800
850
900
950
1000
1050
1100
1150
1200
1250
1300
1350
1400
1450
1500
1550
Phase Transition Pressure - PSIA
Net Density - 40 F
4:1 pressure:density ratio

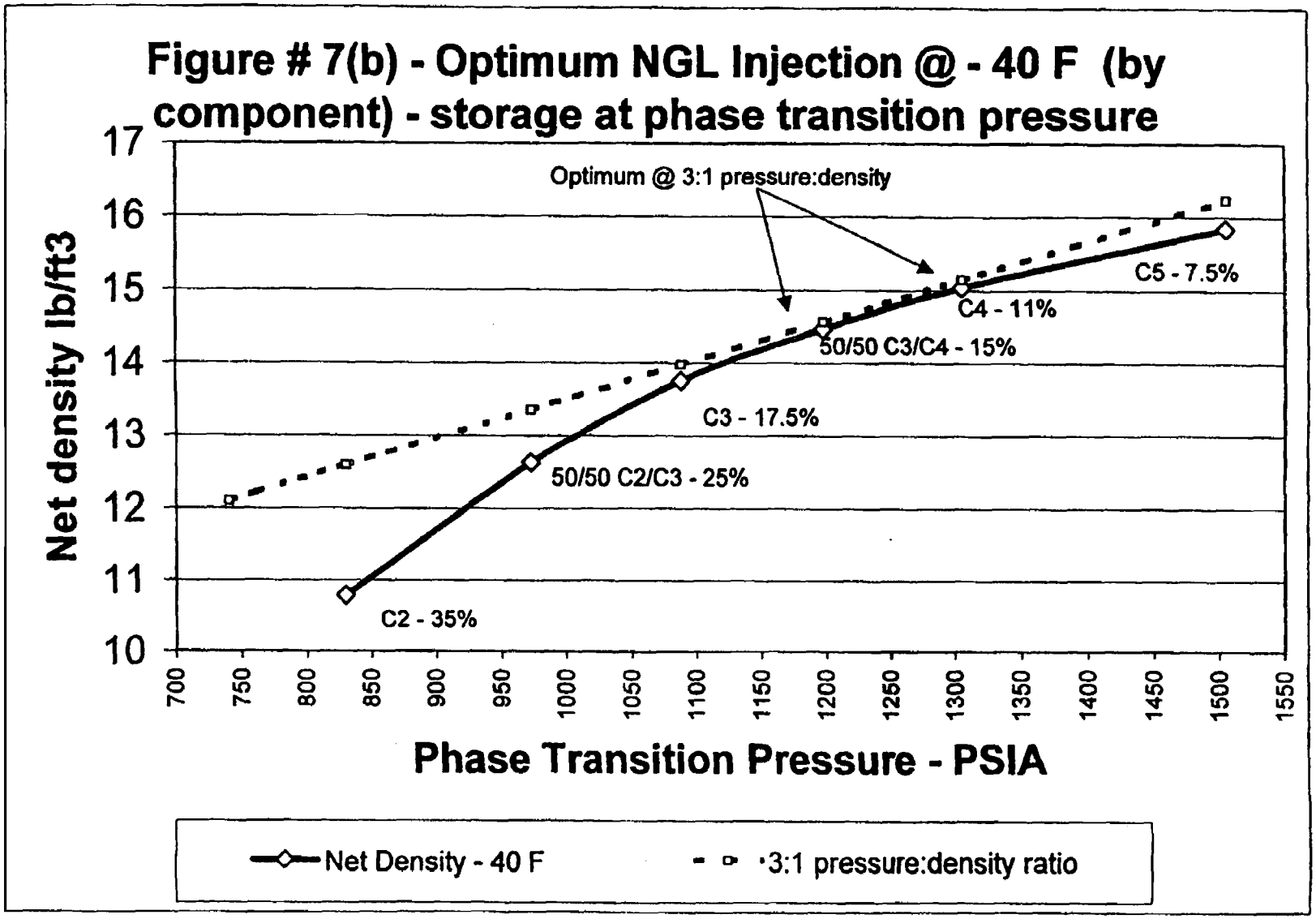
Figure # 7(b) - Optimum NGL Injection @ - 40 F (by component) - storage at phase transition pressure
Optimum @ 3:1 pressure:density
C5 - 7.5%
C4 - 11%
50/50 C3/C4 - 15%
C3 - 17.5%
50/50 C2/C3 - 25%
C2 - 35%
Net density lb/ft3
17
16
15
14
13
12
11
10
700
750
800
850
900
950
1000
1050
1100
1150
1200
1250
1300
1350
1400
1450
1500
1550
Phase Transition Pressure - PSIA
Net Density - 40 F
3:1 pressure:density ratio

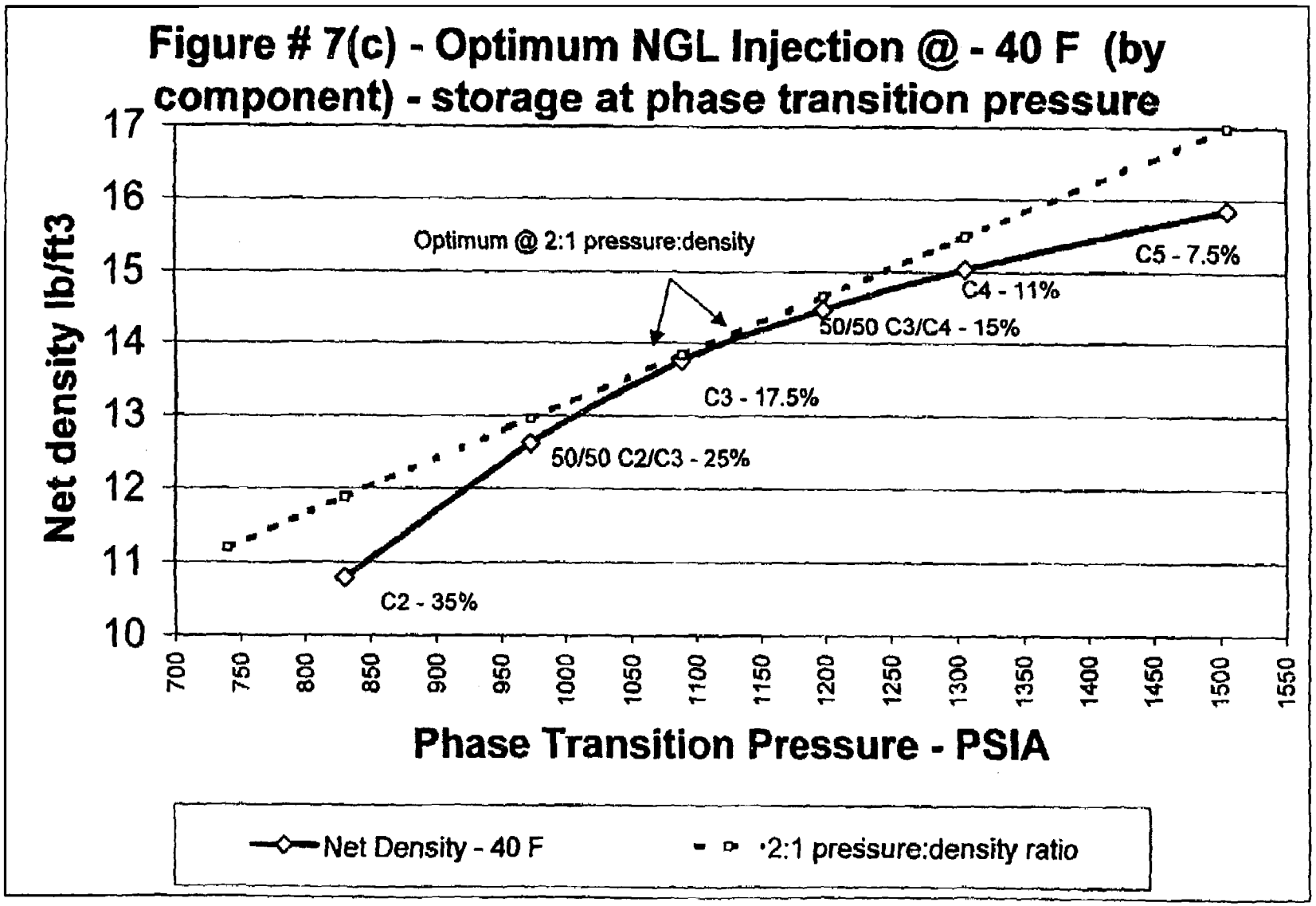
Figure # 7(c) - Optimum NGL Injection @ - 40 F (by component) - storage at phase transition pressure
Net density lb/ft3
17
16
15
14
13
12
11
10
700
750
800
850
900
950
1000
1050
1100
1150
1200
1250
1300
1350
1400
1450
1500
1550
Phase Transition Pressure - PSIA
Optimum @ 2:1 pressure:density
C5 - 7.5%
C4 - 11%
50/50 C3/C4 - 15%
C3 - 17.5%
50/50 C2/C3 - 25%
C2 - 35%
Net Density - 40 F
2:1 pressure:density ratio

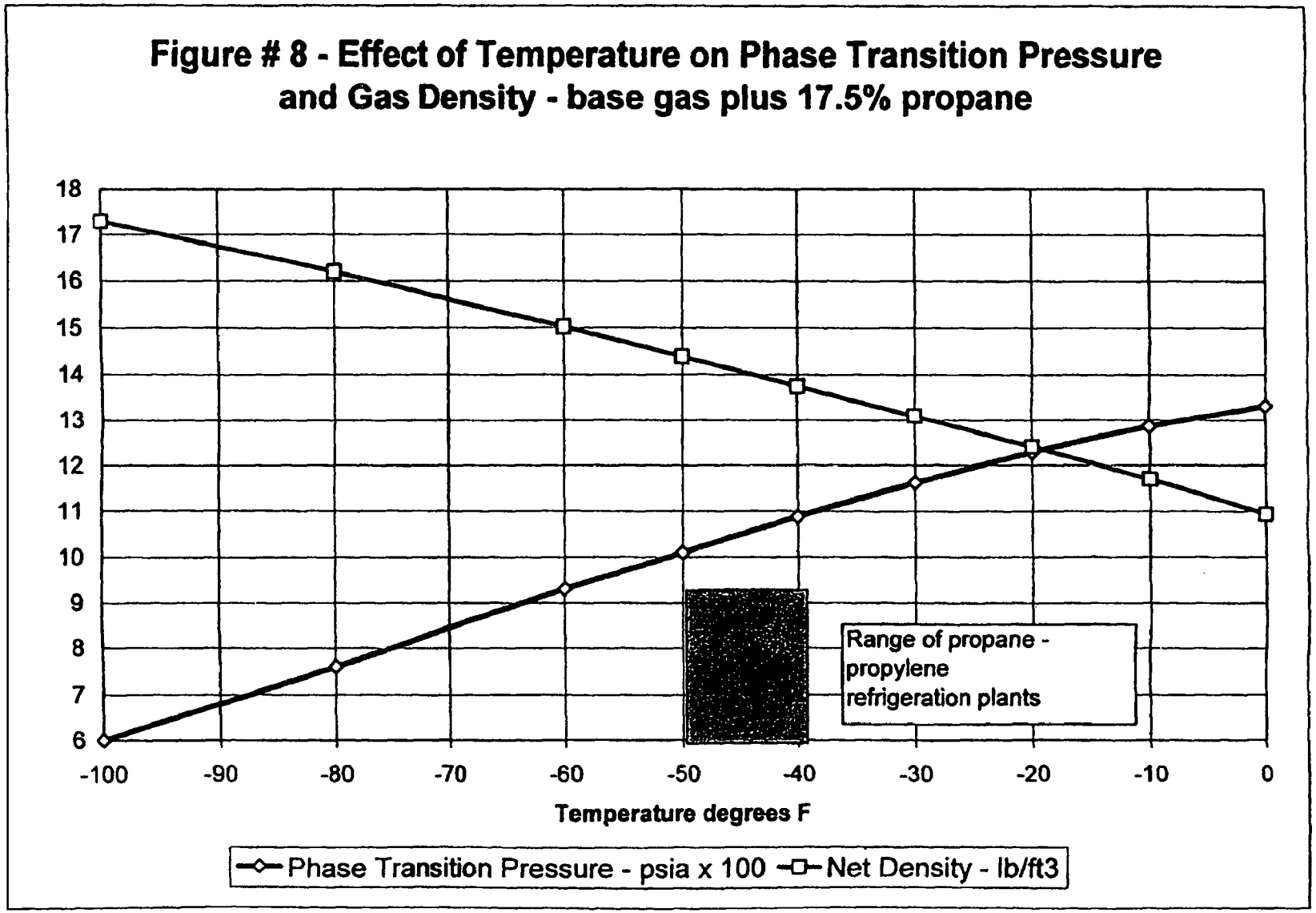
Figure # 8 - Effect of Temperature on Phase Transition Pressure and Gas Density - base gas plus 17.5% propane
18
17
16
15
14
13
12
11
10
9
8
7
6
-100
-90
-80
-70
-60
-50
-40
-30
-20
-10
0
Temperature degrees F
Range of propane - propylene refrigeration plants
Phase Transition Pressure - psia x 100
Net Density - lb/ft3

Figure # 9 - Pressure with and without NGL addition vs. Temperature
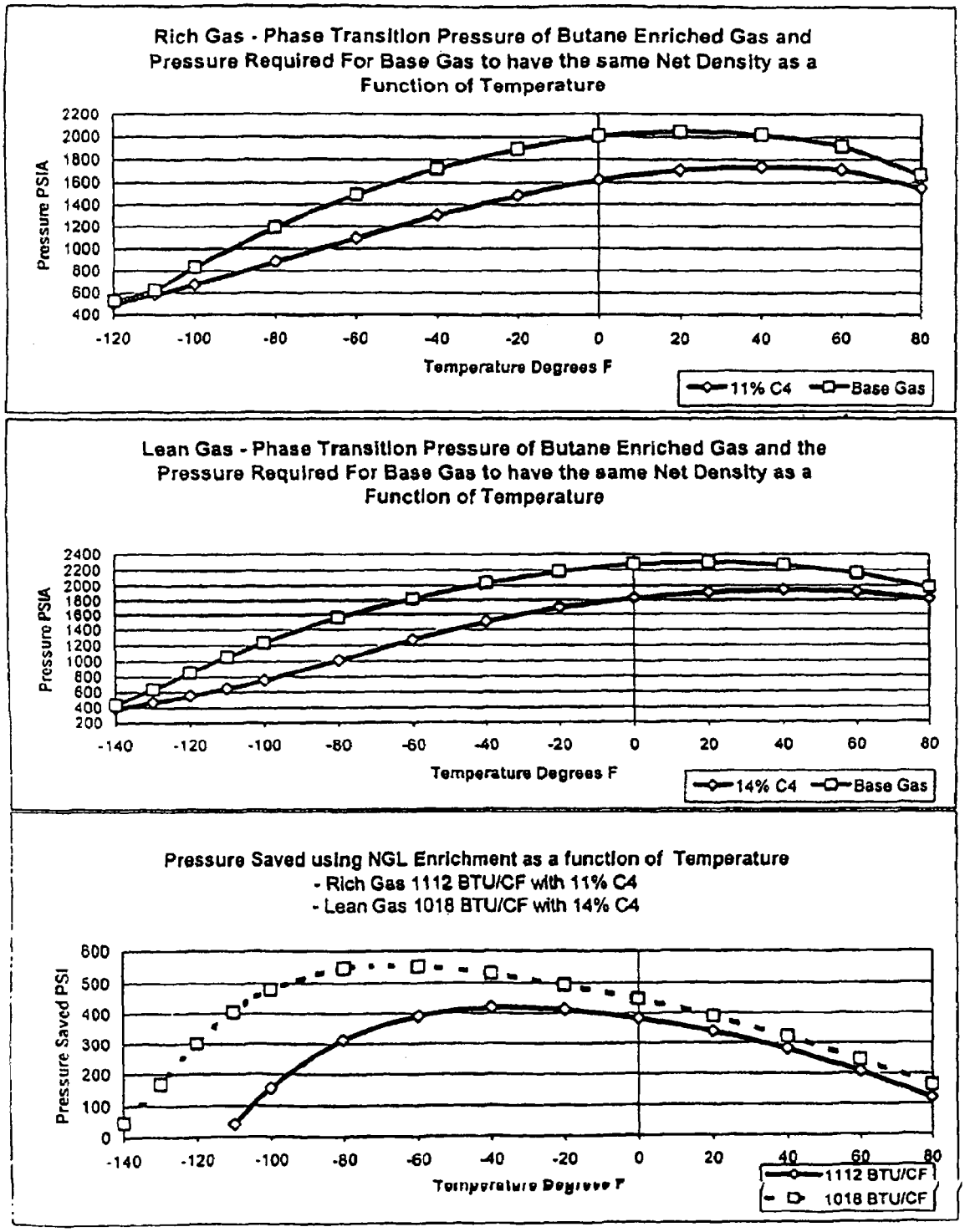

Figure # 10 - Gas Density with and without NGL addition vs. % of phase transition pressure
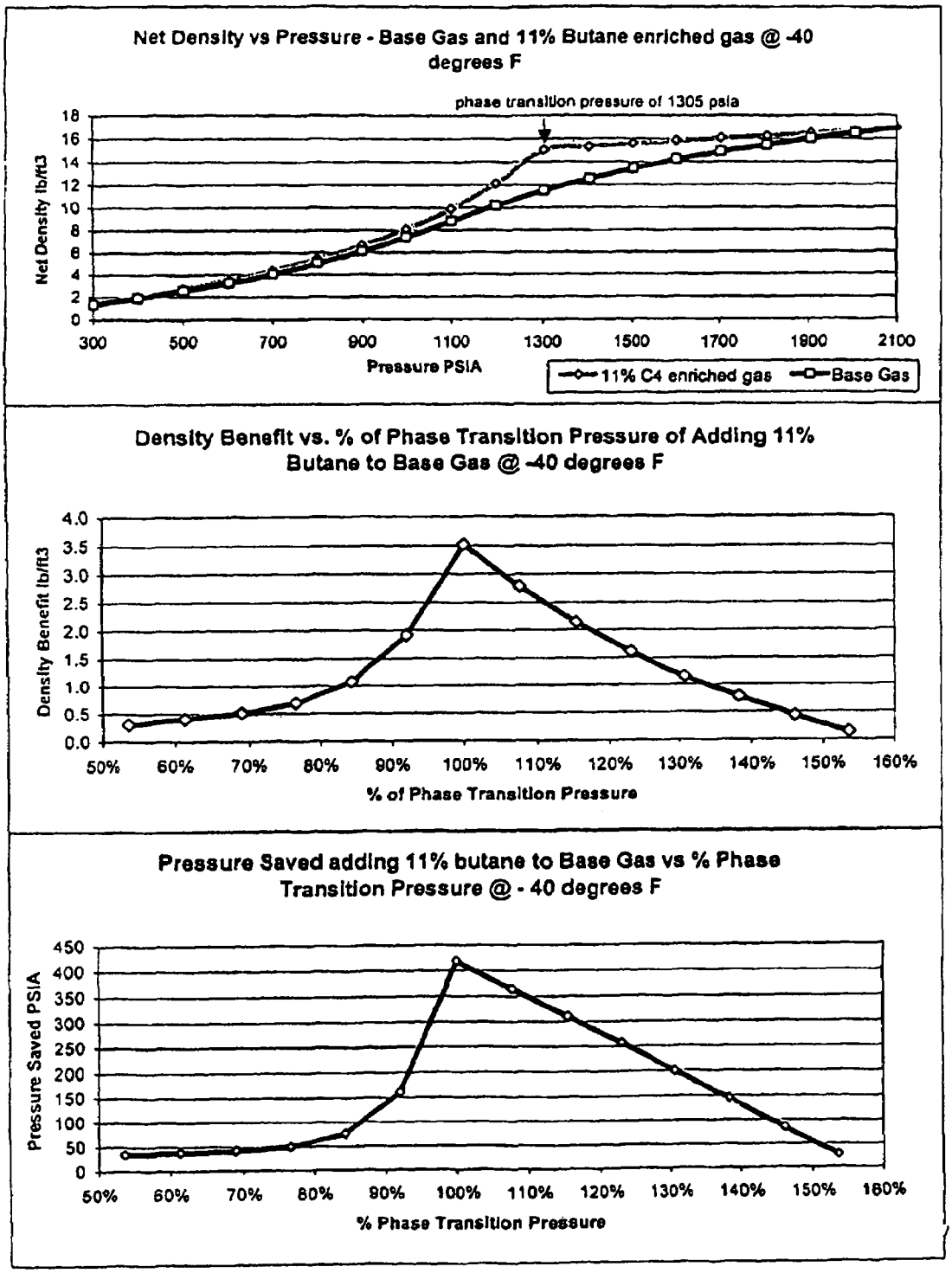

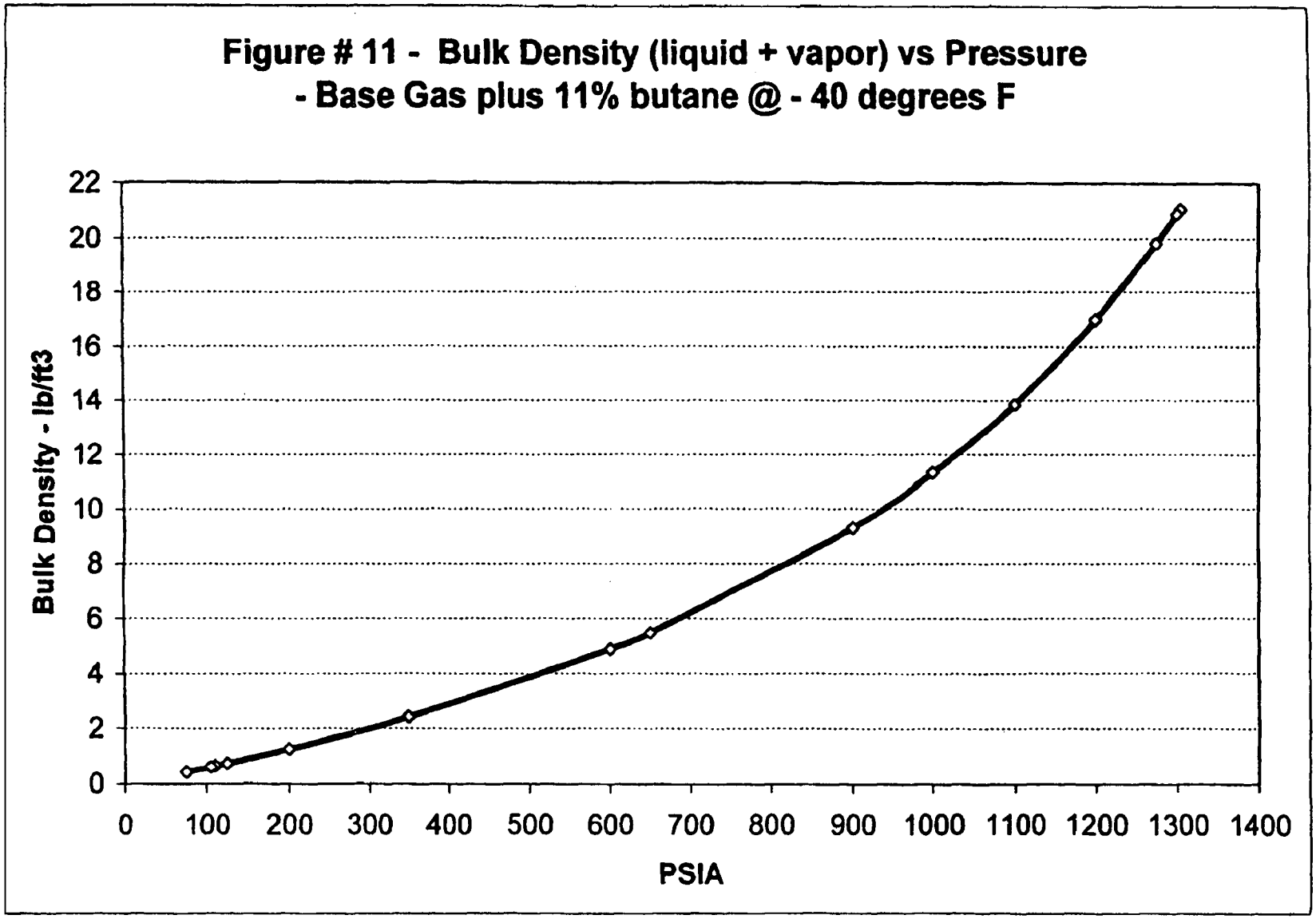
Figure # 11 - Bulk Density (liquid + vapor) vs Pressure
- Base Gas plus 11% butane @ - 40 degrees F
Bulk Density - lb/ft3
0
2
4
6
8
10
12
14
16
18
20
22
PSIA
0
100
200
300
400
500
600
700
800
900
1000
1100
1200
1300
1400

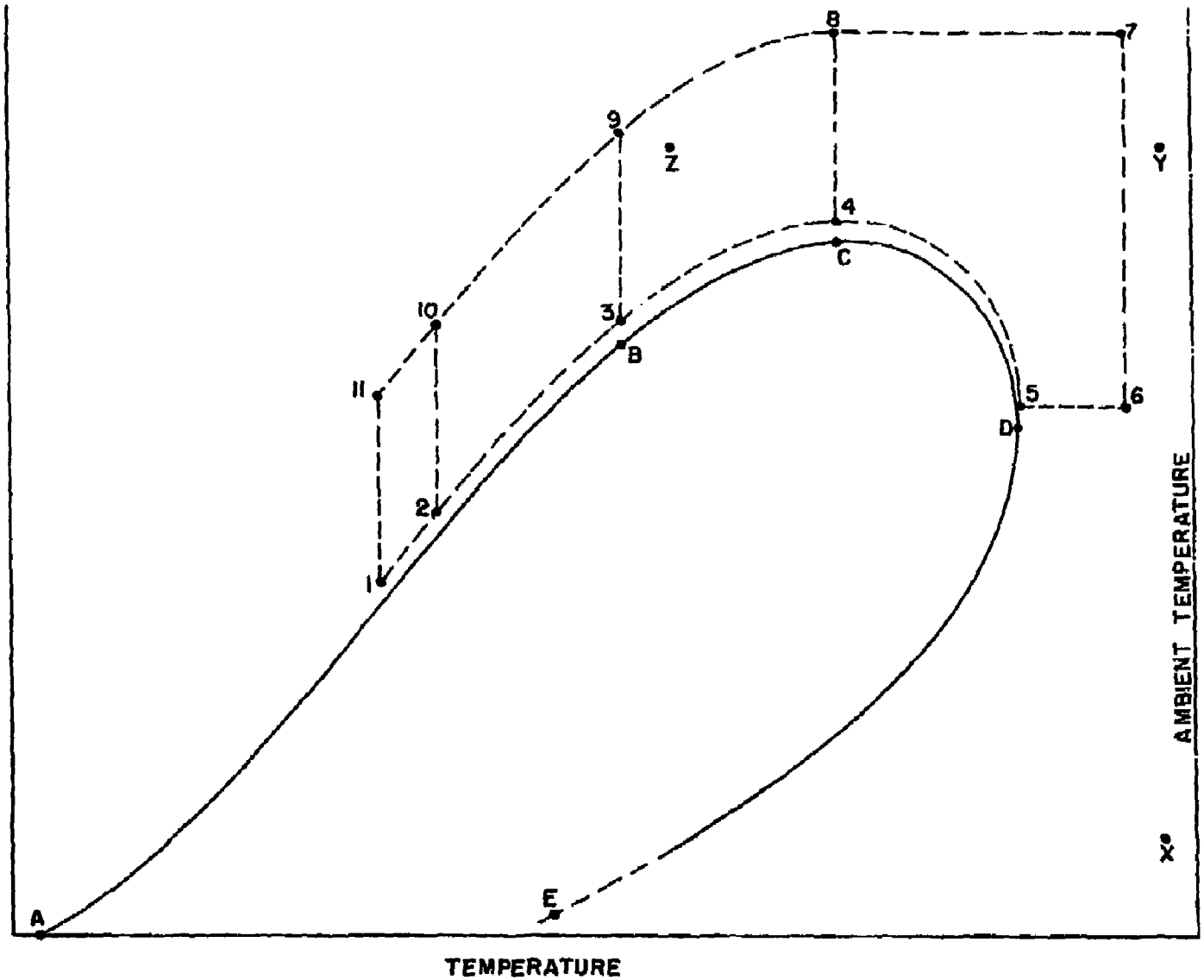
Figure #12

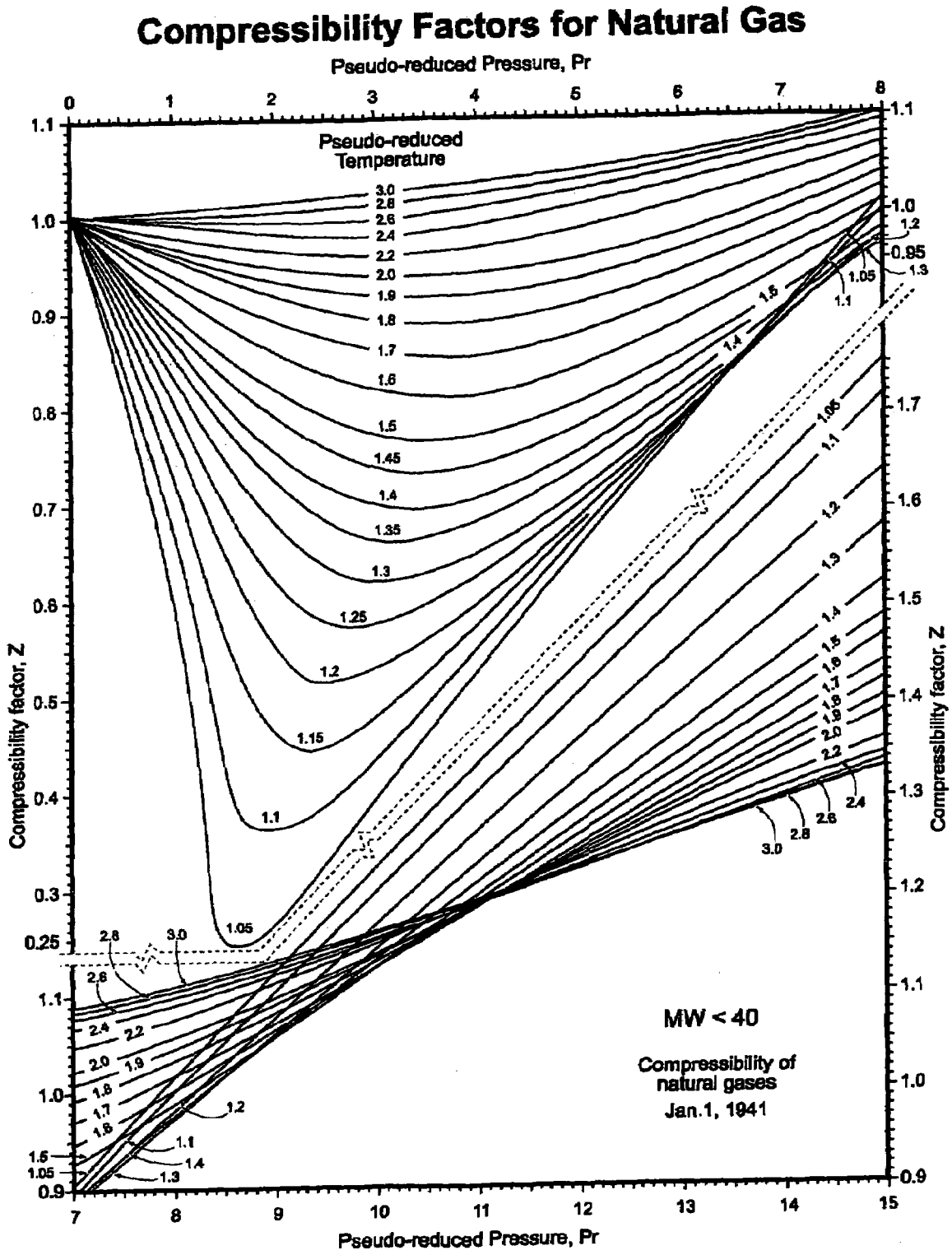
Figure #13

METHOD AND SUBSTANCE FOR REFRIGERATED NATURAL GAS TRANSPORT

CROSS-REFERENCE TO RELATED APPLICATIONS

This application claims the benefit of priority of: U.S. application Ser. No. 10/467,093, filed on Jan. 12, 2004, entitled "Method and Substance for Refrigerated Natural Gas Transport"; PCT Application No. PCT/CA02/00151, filed Feb. 4, 2002 now WO 02/063205 A1, published Aug. 15, 2002; and Canadian Patent No. 2,339,859, issued Feb. 5, 2001, the disclosures of which are incorporated by reference herein in their entireties.

FIELD OF THE INVENTION

This invention deals with the transport of natural gas in containers under pressure, at some level of refrigeration, and addresses the advantageous increase of gas density at ranges of pressure and temperature which are amenable to relatively inexpensive container and vehicle configurations using relatively conventional materials and without need for excessive refrigeration or compression when loading or in transit. The invention is useful in both shipboard and other vehicular refrigerated natural gas transport systems. The invention does not address refrigerated pressurized natural gas pipelines.

BACKGROUND OF THE INVENTION

As is well known, natural gas defines a very broad range of gas compositions. Methane is the largest component of produced natural gas, and usually accounts for at least 80% by volume of what is known as marketable natural gas. Other components include, in declining volume percentages, ethane (3%-10%), propane (0.5%-3%), butane and C4 isomers (0.3%-2%), pentane and C5 isomers (0.2%-1%), and hexane+and all C6+ isomers (less than 1%). Nitrogen and carbon dioxide are also commonly found in natural gas, in ranges of 0.1% to 10%.

Some gas fields have carbon dioxide contents of up to 30%. Common isomers found in natural gas are iso-butane and iso-pentane. Unsaturated hydrocarbons such as ethylene and propylene are not found in natural gas. Other contaminants include water and sulphur compounds, but these must typically be controlled to very low levels prior to sale of the marketable natural gas, regardless of the transport system used to get the produced gas from wellhead to market.

Secord and Clarke in U.S. Pat. Nos. 3,232,725 (1963) and 3,298,805 (1965) describe the benefits of storage of gas at conditions of temperature and pressure which occur when the gas exists at a single dense phase fluid state, at pressures just above the phase transition pressure. This state is shown in the generic phase diagram (taken from U.S. Pat. No. 3,232,725) attached hereto at FIG. 12, and is shown as occurring within the dotted lines on the diagram.

The relation between pressure, volume and temperature of a gas can be expressed by the Ideal Gas Law, which is stated as PV=nRT where, using English units:

P=pressure of the gas in pounds per square inch absolute (psia)

V=volume of the gas in cubic feet (CF)

n=number of moles of the gas

R=the universal gas constant

T=temperature of the gas in degrees Rankin (degrees Fahrenheit plus 460)

The Ideal Gas Equation must be modified when dealing with hydrocarbon gases under pressure, because of the intermolecular forces and the molecular shape. To correct for this, an added term, the compressibility factor z must be added to the Ideal Gas Equation such that PV=znRT. This z is a dimensionless factor that reflects the compressibility of the particular gas being measured, at the particular conditions of temperature and pressure.

At or near atmospheric pressure, the z factor is sufficiently close to 1.0 that it can be ignored for most gases, and the Ideal Gas Equation can be used without the added z term.

However, where pressures exceed a few hundred psia the z term can be much lower than 1.0 so that it must be included in order for the Ideal Gas Equation to give correct results.

According to the van der Waal's theorem, the deviation of a natural gas from the Ideal Gas Law depends on how far the gas is from its critical temperature and critical pressure. Thus, the terms Tr and Pr (known as reduced temperature and reduced pressure respectively) have been defined, where $$Tr=T/Tc$$

$$Pr=P/Pc$$

Where,

T=the temperature of the gas in degrees R

Tc=the critical temperature of the gas in degrees R

P=the pressure of the gas in psia

PC=the critical pressure of the gas in psia

Critical pressures and critical temperatures for pure gases have been calculated, and are available in most handbooks. Where a mixture of gases of known composition is available, a "pseudo critical temperature" and "pseudo critical pressure" which apply to the mixture can be obtained by using the averages of the critical temperatures and critical pressures of the pure gases in the mixture, weighted according to the mole percentage of each pure gas present. The pseudo reduced temperature and the pseudo reduced pressure can then be calculated using the pseudo critical temperature and the pseudo-critical pressure respectively.

Once a pseudo reduced temperature and pseudo reduced pressure are known, the z factor can be found by using standard charts. An example of one of these is "FIG. 23-3 Compressibility Factors for Natural Gas", by M. B. Stranding and D. L. Katz (1942), published in the Engineering Data Book, Gas Processors Suppliers Association, edition (Tulsa, Okla., U.S.A.) 1987 (and a copy of that chart is attached hereto as FIG. 13).

One aspect of the prior art is described in U.S. Pat. No. 6,217,626 "High pressure storage and transport of natural gas containing added C2 or C3, or ammonia, hydrogen fluoride or carbon monoxide". That patent describes a method for storing and subsequently transporting gas by pipeline whereby adding the light hydrocarbons of ethane and propane (or ammonia, hydrogen fluoride or carbon monoxide) can increase the capacity of the pipeline or can reduce the horsepower required on a pipeline to propel such a gas mixture down the line. The primary claim is for creating a mixture by addition of propane of ethane where the product of the z factor (z) and the molecular weight (MW) for the new mixture reduces as compared to a mixture without the added ethane or propane, yet where there is no presence of liquids, only a single phase gas vapor.

The benefit arises because of the gas pipeline flow equation. There are several forms of this equation, but they all have the following features in common:

$$\text{Flow}=\text{constant } 1\ [((P1\hat{}2-P2\hat{}2)/(S*L*T*z))\hat{}0.5]*(D\hat{}2.5)$$

Where:

PI=starting pressure in a pipeline

P2=ending pressure in a pipeline

S=specific gravity of the gas (which is equivalent to molecular weight)

L=length of the pipeline

T=temperature of the gas z=compressibility factor of the gas

D=internal diameter of the pipeline

In this equation, the two factors that are altered by changing the gas composition are the specific gravity (or molecular weight) "S", and the z factor "z". Both of these appear in the denominator of the equation. Therefore, if the product of z and MW or "S" reduces, and all other factors remain constant, flow on the pipeline will increase at a similar pressure differential between the starting and ending points. This is a benefit in pipeline transmission, which can be described either as a capacity gain or a reduced horsepower requirement to propel a given volume down the pipeline.

The primary claim in the U.S. Pat. No. 6,217,626 is adding C2 or C3 to natural gas for a reduction in the product of z and MW (or S), above a pressure of 1000 psig and with no discernible liquid formation. The benefits described under the patent relate to increased capacity or reduced horsepower on a pipeline.

The teachings under the patent describes a mixture in which the primary barrier to increasing benefits is the two-phase state created if too much NGL is added to the gas. This two-phase state leads to physical damage of the pipeline equipment, and reduced flow, and must be avoided. Several of the subsequent claims limit the amount of ethane to 35% and the amount of propane to 12% in order to avoid this two-phase state on the pipeline. Several of the claims state a minimum amount of added ethane and propane, again based on the benefits in pipeline application. No mention is made in U.S. Pat. No. 6,217,626 of adding any hydrocarbons heavier than propane, such as butane or pentane, and in fact, the teachings describe how these heavier hydrocarbons should be avoided, as they lead to premature development of the two-phase state. See page 6, "Thus C4 hydrocarbons are not additives contemplated by this invention." Furthermore, "The presence of more than 1% C4 hydrocarbons in the mixture is not preferred, however, as C4 hydrocarbons tend to liquefy easily at pressures between 1000 psia and 2200 psia and more than 1% C4 hydrocarbons give rise to increased danger that a liquid phase will separate out. C4 hydrocarbons also have an unfavorable effect on the mixture's z factor at pressures under 900 psia so care should be taken that, during transport through a pipeline, mixtures according to the invention that contain C4 hydrocarbons are not allowed to decompress to less than 900 psia and preferably not to less than 1000 psia.

The control mechanism proposed in the '626 invention to avoid the two-phase state is thus the type and amount of NGL added to the mixture. This is because, in a pipeline, temperature and pressure are usually exogenous variables, not subject to any fine degree of control. Refrigeration is mentioned only once in '626, and in a negative sense. While some of the claims deal with mixtures down to a temperature of −40 degrees F., the following statement appears on page 10 of the '626 patent: "Even more preferred pressures are 1350-1750 psia (which gives good results without requiring vessels to withstand higher pressures) and particularly preferred temperatures are 35 to 120 degrees F. (Which do not require undue refrigeration)". The benefits of the invention are illustrated in the graphs attached to '626, which all terminate at a lower temperature limit of 30 to 35 degrees F. Even though the pipeline flow equation illustrates that pipelines are more efficient at colder temperatures (see the factor T in the denominator), no analysis is provided at lower temperatures. This is primarily because refrigeration is not practical in pipeline applications, as the pipe temperature should be above the freezing point of water, in order to prevent frost build up on and around the pipeline.

It is clear that the invention in U.S. Pat. No. 6,217,626 is based on preparation in storage of a fluid with the stated desire of subsequent pipeline transport, and that no refrigeration is contemplated, that the type and minimum amount of NGL added is limited by the benefits provided in pipeline transport, that the type and maximum amount of NGL added is limited by the two-phase problem which will occur on the contemplated pipeline transmission, and that the pressure regime is limited by the subsequent pipeline transmission. While the prior art implies benefits for both storage and pipeline transport, the storage aspect of the prior art is limited to or by pipeline applications, and does not contemplate storage in containers which are themselves later transported.

Another aspect of the prior art is contained within U.S. Pat. No. 5,315,054 "Liquid Fuel Solutions of Methane and Light Hydrocarbons". This patent deals with a method to store a liquid product where Liquified Natural Gas (LNG) is put into an insulated tank at a temperature of about −265 degrees F. Both methane and NGL are introduced into the tank, the methane and LNG is dissolved in the NGL hydrocarbon solution (typically propane or butane), and the resulting mixture is stored as a stable liquid under moderate pressure. This invention does not contemplate storage as a single dense phase fluid, and it is also conditional upon LNG being present in the tank to begin with.

Another aspect of the prior art is described in U.S. Pat. Nos. 5,900,515 and 6,111,154 "High energy density storage of methane in light hydrocarbon solutions". This invention is similar to the previous example 315,054 and is described as the "dissolution of gaseous methane into at least one light hydrocarbon into a storage tank" and "storage of the solution". In addition, the solution has to be maintained at a temperature above −1 degree C. at a pressure above 8.0 Mpa comprise a maximum of 80% methane and have an energy density of at least 11,000.

Another aspect of the prior art is described in the previously referenced U.S. Pat. No. 3,298,805 which describes storage of natural gas under pressure, without any additives, at or near the phase transition pressure but at a temperature below the critical temperature of methane (−116.7 degrees F.). This is a continuation of U.S. Pat. No. 3,232,725 which describes storing natural gas under pressure, again without any additives, at or near the phase transition pressure at a temperature 20 degrees (F.) below ambient temperature.

Another aspect of the prior arts is described in U.S. Pat. No. 4,010,622 which describes adding hydrocarbons in the range of C5-C20 sufficient to liquefy the gas at ambient pressure and store it as a liquid, which is given as an example with bearing on the formulae expressed above, but not of much relevance to this invention.

SUMMARY OF THE INVENTION

For the storage of natural gas in a container under pressure, and the subsequent transport of the loaded storage container and gas, it is advantageous to refrigerate the natural gas below the ambient temperature, and to add to the natural gas an additive that is a natural gas liquid such as a C2, C3, C4, C5 or C6+ hydrocarbon compound (including all isomers and both saturated and unsaturated hydrocarbons), or carbon dioxide, or a mixture of such compounds. Alternatively, methane or a lean gas mixture can be removed from a natural gas mixture richer in indigenous NGL to achieve the same effect.

When combined with storage conditions at an optimal pressure and temperature, the addition of NGL will increase the net gas density (net referring here to the gas's density excluding the added NGL) above what the gas density would be at these same conditions of temperature and pressure without the added NGL.

The increase in gas density leads to lower storage and transport costs.

The operating pressure range over which adding NGL to the gas provides benefits for storage and subsequent transport is between 75% and 150% of the phase transition pressure (PTP) of the gas mixture, with the greatest benefit occurring right at and just above the phase transition pressure.

(The phase transition pressure is defined as that point at which a rising pressure causes the particular gas mixture to transition from a two-phase state to a dense single phase fluid, with no liquid/vapor separation within the container. This point is also commonly referred to as the bubble point line and/or the dew point line.) The temperature range over which adding NGL to the gas provides benefits for storage and subsequent transport, when operating at or near the phase transition pressure, is −140 degrees F. to +110 degrees F. As refrigeration on its own provides benefits in increased density and also has a synergistic effect on the benefit provided by adding NGL, refrigerating the gas to less than or equal to 30 degrees F. is another aspect of this invention.

It has now been found that, for natural gas storage in a container, and subsequent transport of the loaded container and contained gas, for any typically occurring natural gas mixture, it is advantageous to add to the natural gas an additive that is C2, C3, C4, C5 or C6+ or carbon dioxide, or a mixture of these compounds, where the resulting mixture is stored at a pressure between 75% and 150% of the phase transition pressure of the gas mixture, and where the gas temperature is between −140 degrees F. and +30 degrees F.

The resulting mixture exhibits a higher net density (excluding the additive) at a lower pressure than would the base natural gas without the additive.

Refrigerating the gas below ambient temperature increases the benefit of adding NGL.

The temperature, pressure, optimum amount and optimum type of additive depends on the particular characteristics of the gas in trade. These characteristics include the economically achievable refrigeration temperature, the base gas composition, the type of trade, being a Recycle Trade (where the additive is re-cycled) or a NGL Delivery Trade (where the additive is delivered to market along with the gas), the economics of the transportation system utilizing this invention (e. g. Ship, truck, barge, other), and the phase transition pressure of the gas mixture. As higher gas density implies greater capacity in a volume-limited storage-and-transport system, and lower pressure leads to lower cost preparation and storage containment, the resulting unit transportation cost will reduce as a result of using the invention.

DESCRIPTION OF THE FIGURE

FIG. 1: Gross Density v. Pressure at −40 degrees F.

FIG. 2: Net Gas Density of CNG (at +60 and −40 degrees F.) and FNG at Phase Transition Pressure degrees F. with 5% to 60% propane addition FIG. 3: Optimum Amount of Propane Blend at the Phase Transition Pressure and −40 degrees F. with 10% to 60% added propane FIG. 4: Optimum Amount of Butane Blend at Phase Transition Pressure degrees F. with 5% to 25% added Butane FIG. 5: Net Gas Density of Ethane, Propane, Butane and Pentane Blends at Phase Transition Pressure and −40 degrees F.

FIG. 6: Effect of Temperature and NGL Addition on Net Gas Density

FIG. 7(*a*): Optimum NGL Injection at −40 F. (by component) storage at phase transition pressure FIG. 7(*b*): Optimum NGL Injection at −40 F. (by component) storage at phase transition pressure FIG. 7(*c*): Optimum NGL Injection at −40 F. (by component) storage at phase transition pressure FIG. 8: Effect of Temperature on Phase Transition Pressure and Gas Density-base gas plus 17.5% propane FIG. 9: Pressure with and without NGL addition vs. temperature FIG. 10: Gas Density with and without NGL addition vs. % age of Phase Transition Pressure FIG. 11: Bulk Density (liquid+vapour) vs. Pressure-Base Gas plus 11% butane at −40 degrees F.

FIG. 12: A reproduction of a generic phase diagram from 725

FIG. 13: FIG. 23-3 Compressibility Factors for Natural Gas", by M. Stranding and D. L. Katz (1942), published in the Engineering Data Book, Gas Processors Suppliers Association, edition (Tulsa, Okla., U.S.A.) 1987

DETAILED DESCRIPTION OF THIS INVENTION

Gas storage economics are improved by increasing the gas density of the natural gas and minimizing the pressure of the storage system. When one is trying to maximize the gas density at some minimum pressure, one way that this is achieved is by minimizing the compressibility factor z.

When the compressibility factor z is read from the attached textbook FIG. 23-3 at FIG. 13, two factors become apparent. The first is that the minimum z factor occurs with a gas that has a pseudo reduced temperature close to 1. This means that the actual gas temperature should be close to the pseudo critical temperature of the mixture. The second is that, if one can economically achieve a pseudo reduced temperature of about 1.2 and a resulting z factor of about 0.5 through low cost refrigeration alone, changing the gas composition by adding NGL to reduce the pseudo reduced temperature to close to 1 can reduce the z factor to about 0.25.

Thus, a 16% reduction in the pseudo reduced temperature can reduce the z factor by 50% and increase the gas density by a factor of 200%. Adding NGL reduces the pseudo reduced temperature. If the portion of added NGL is less than the increase in density, the base gas will show an increase in net density. In addition, as the inflection point of the z factor curve is at a lower pressure as the pseudo reduced temperature approaches 1, the system can show this increased density at a lower pressure as NGL is added, thus effecting more benefit.

The following example will illustrate this principle of increased density at reduced pressure with refrigeration to −40 degrees F.:

Methane has a critical temperature of −116.7 degrees F. (343.3 degrees R.) and a critical pressure of 667 psia. The minimum temperature one can currently achieve with low cost single cycle refrigeration plants based on propane is in the order of −40 degrees F. (420 degrees R.). The pseudo reduced temperature of methane at −40 degrees F. is 1.223, that being 420 degrees R. divided by 343.3 degrees R. From drawing 23-3 at FIG. 13, this implies that the minimum z factor for methane would occur at a pseudo reduced pressure of about 2.676 (1785 psia). The z factor would be 0.553. The resulting gas density is 11.5 or an increase of 272 times over the gas density at standard temperature and pressure (STP) of 0.0423 lb/CF. The gas density of methane at 1785 psia and an ambient temperature of +60 degrees F. (pseudo reduced temperature of 1.515) would be 6.52 lb/CF with a z factor of 0.787. Thus, refrigeration increases the methane density by a factor of 11.50 divided by 6.52 or 1.76 times.

N-Butane has a critical temperature of 305.5 degrees F. (765.5 degrees R.) and a critical pressure of 548.8 psia. Adding 14% n-butane to 86% methane would yield a pseudo critical temperature of the mix of −57.6 degrees F. (402.4 degrees R.) and a pseudo critical pressure of 650.5 psia. The pseudo reduced temperature of the mix at −40 degrees F. (420 degrees R.), is equal to 1.044. The phase transition pressure of this mixture at −40 degrees F. is 1532 psia at a pseudo reduced pressure of 2.36. At these conditions, the z factor of the mix is 0.358 and the gas density is 20.84 lb/CF. The density of an 86% to 14% (by mole volume) methane/butane mix at STP is 0.0578 lb/CF of which the 14% injected butane represents 37.06% by weight, the methane representing the remaining 62.94%. The net methane density is 62.94% of 20.84 lb/CF or 13.1 lb/CF The process of adding n-butane increases the net gas density by a factor of 13.11 lb/CF divided by 11.50 lb/CF or 1.14, while the pressure reduces by 253 psia from 1785 psia to 1532 psia.

Combining the two actions of refrigeration from +60 degrees F. to −40 degrees F. and adding 14% n-butane increases the net gas density by a factor of 2.05, from 6.52 lb/CF to 13.1 lb/CF while reducing the pressure by 14% from 1785 psia to 1532 psia.

As the critical temperature of methane is −116.7 degrees F., it is to be expected that, as the gas temperature approaches this value, and the pseudo reduced temperature of pure methane approaches 1.0, the benefit of reducing the z factor by adding NGL would be reduced or eliminated. Taken together with the fact that the added NGL takes up storage capacity of the blended mix, there is a lower temperature limit below which adding NGL will show no benefit.

FIG. 13's textbook drawing 23-3 shows that the beneficial effect of reducing z factor from reducing the critical temperature is much less at higher critical temperatures. This is illustrated in drawing 23-3 by calculating the difference in z factor between a critical temperature of 2.2 and 2.0 (the z factor goes from 0.96 to 0.94) and a critical temperature between 1.2 and 1.0 (the z factor goes from 0.52 to 0.25). Thus, there is an upper temperature limit, above which adding NGL will show no benefit.

Were it not for the effect of the z factor, the NGL enriched gas would show a lower net density than the base gas, as it contains an exogenous component that must be re-cycled and does not contribute to the useable density. As this NGL enriched gas is much less compressible above the phase transition pressure, while the base gas is more compressible, there is an upper limit on pressure where the density of the refrigerated base gas would exceed the net density of the refrigerated NGL enriched gas.

There is also a lower limit on pressure where the density of the base gas would exceed the net density of the NGL enriched gas. This is because the NGL enriched gas immediately transforms into a two-phase state below the phase transition pressure, and the density falls off dramatically with falling pressure. This fall off in density is caused by the vapor component of the two-phase state, which grows rapidly as the pressure falls. While it is possible to remove the vapor to maintain a high density liquid within the container, this is accomplished by removing methane, and thus the net methane density falls dramatically below the phase transition pressure. Thus, there is a lower pressure limit below which adding the NGL would show no benefit.

For preparation and storage of natural gas for long haul, ocean based, ship-transport applications, LNG is the only large-scale commercially viable technology currently available. With LNG, preparation is very costly, as it involves refrigerating the gas to degrees F. However, once at this condition, transporting the natural gas is relatively low cost, as the density has increased 600 times over the density of the gas at STP and the storage is at or near atmospheric pressure.

This invention provides an alternative to LNG for ship-based applications. With this invention, natural gas can be mildly refrigerated to the economic temperature limit of low cost refrigeration systems and low cost, low carbon steel containment systems, NGL is added to the natural gas at the supply end, and the gas can be stored at a pressure which is at or near the phase transition pressure. In applications where no surplus NGL exists at the supply source, the added NGL is extracted at the delivery end and re-cycled back to the supply end in the same storage container for adding to the next shipment (Recycle Trade). For applications where surplus NGL exists at the supply end, or the combined blended mix is consumed in transit, none or only a portion of the NGL needs to be re-cycled (NGL Delivery Trade).

The invention also provides an alternative to compressed natural gas (CNG) for smaller scale applications such as cars, buses or rail. CNG operates at ambient temperature but at very high pressures of 3000-3600 psia. These high pressures require significant compression for preparation, and requires storage containers to handle almost three times the pressure of the invention described herein. Achieving similar density as CNG at one-third the pressure would provide benefits in applications where the gas mixture was consumed to provide the fuel for transport (as in cars, buses and rail), as well as a transport mechanism for natural gas in overland applications where pipelines are not present or economical.

The benefit of refrigeration and adding NGL occurs over a large range of temperature, pressure, NGL composition and NGL blending. The optimum type and amount of added NGL is dependent on the base gas composition, the desired conditions of temperature and pressure, whether the trade is a Recycle Trade or an NGL Delivery Trade and the economics of a specific trade.

With LNG, carbon dioxide must be removed, or else it would solidify in the process of refrigerating the gas to −260 degrees F. With this invention, carbon dioxide may be left in the gas, and in fact, can have certain beneficial effects on the system such that it could be desirous to contain some carbon dioxide.

Due to the very lightweight nature of natural gas, (even LNG at 600 times the density gain over STP only has a specific gravity of about 0.4), gas carrying ship transport systems are primarily volume-limited systems, not weight-limited. For example, an LNG ship typically contains aluminum spheres with a 130 foot diameter, and they have 39 feet of draft. Thus, 70% of the ship is above the water line. The extra weight inherent in a ship utilizing this invention, caused by the weight of the re-cycle NGL and the steel container, would reduce this to about 55% above the water line, still quite acceptable in the shipping industry. This extra weight has minimal economic consequence, primarily related to additional fuel and power to go a given ship transport speed. In a volume-limited gas transport system such as a ship, gas density is the key variable and is directly related to cargo capacity and unit cost.

The working temperature regime will be based on the economics of refrigerating the gas and storing it in containers. For illustrative purposes, all the following examples are based on a storage temperature of −40 degrees F., unless otherwise noted. This is approximately the current lower limit of propane refrigeration, being based on the boiling point of propane at −44 degrees F.

The benefit of using this form of refrigeration is illustrated in the following: The refrigeration requirement of any gas storage system is very approximately related to the temperature change required. Thus, for LNG, a temperature drop of 320 degrees F. is required to go from +60 degrees F. to −260 degrees F. With this system, the temperature drop is 100 degrees F., to go from +60 degrees F. to −40 degrees F. This system requires about ⅓ of the refrigeration of a comparable LNG system. In order to achieve a temperature of −260 degrees F., LNG plants usually require 3 cycles of refrigeration, involving propane, ethylene and methane as refrigerants (referred to as a "cascade cycle"). Each cycle involves inefficiency in the process, such that the overall efficiency of LNG refrigeration is about single-cycle propane refrigeration system has an efficiency of about 80%. This reduces the refrigeration requirement with the system of this invention even further, to about ¼ of that required for LNG. The LNG refrigeration plant must be constructed of cryogenic materials and must remove all carbon dioxide from the base gas. The −40 degree F. plant can be made of material and the carbon dioxide may remain in the gas. The overall capital cost of the −40 degree F. refrigeration plant is therefore in the range of 15%-20% of a similarly sized LNG plant, and the fuel consumption is about ¼ of the LNG plant. An LNG plant will consume between 8% and 10% of the total product liquefied, while the −40 degree F. plant will consume between 2% and 2.5% of the total product refrigerated. As LNG liquefaction is a large portion of the overall cost of the LNG transport system, this savings translates into a large economic advantage, which can help defray the potential extra cost of the newer style of non-LNG transport ships themselves.

For these reasons, manufacturing LNG as a mechanism to create the refrigeration required by this invention is not a very efficient method. Lower cost refrigeration systems exist, and are well known to those skilled in the art. Heating the gas for delivery at the market end also shows a benefit with this system over LNG. This system consumes about ⅓ to ½ the energy as LNG. Thus, an LNG re-gasification plant consumes between 1.5% and 2% of the product as fuel, while this system consumes 0.5% to 1% of the product as fuel.

(The Clearstone Thermodynamics Programs developed by Clearstone Engineering Ltd is used as the source for all thermodynamic calculations included herein.)

Once a temperature regime is chosen, and a gas mixture is prepared by adding NGL to the base gas, the optimum storage pressure is that point at which, with rising pressure, the gas transitions from a two-phase state to a dense single phase fluid state. This is because, in a two-phase state, the mixture separates into a vapor state and a liquid state. As the density of the vapor phase would be very low, the bulk density of the overall two-phase state would be low. Increasing the pressure to achieve the dense single phase fluid state eliminates this loss of bulk density. This phenomenon is illustrated by FIG. 1-*Gross* Density vs. Pressure minus 40 degrees F.

In FIG. 1 and the following figures, a Base gas is assumed to have the following composition:

Methane 89.5%
Ethane 7.5%
Propane 3.0%
The heat content is 1112 BTU/CF
The critical temperature is −91.5 degrees F.
The critical pressure is 668.5 psia.
The density is 0.0473 lb/CF at 14.696 psia and 60 degrees F. (STP)

Three gas mixtures are prepared by adding NGL to the Base gas:

35.0% ethane and 65.0% of the Base gas
17.5% propane and 82.5% of the Base gas
11.0% n-butane and 89.0% of the Base gas FIG. 1 illustrates the bulk (gross) density of the mixtures at −40 degrees F. The density increases dramatically with pressure for all three mixtures up to a level of about 21 lb/CF (pounds per cubic foot), at which point there is almost no further increase in density with rising pressure. This point corresponds to the phase transition point between a two-phase state and a single dense phase fluid state for each of the mixtures. Above this phase transition point the gas is almost non-compressible, such that there is minimal benefit of increased density with increases in pressure beyond this point. The optimum storage pressure is therefore that point at which the phase transition between the two-phase state and the single dense phase fluid state occurs.

Note that the phase transition occurs at very different pressures, depending on the particular NGL chosen for the blend. The lower the carbon number of the NGL additive (for example, butane has a carbon number of 4) the lower is the pressure at which the phase transition occurs.

This chart illustrates the wide range of choice in choosing the optimum additive for any particular trade, even after the temperature is chosen. Deciding on the type and quantity of added NGL is complex and depends on the economics of the particular trade.

For any particular NGL blend composition, deciding on the quantity of additive is relatively straightforward within a narrow range. For any chosen temperature, with storage at the phase transition pressure, any gas mixture will show increasing net density by adding additional NGL up to a sharp inflection point Above this inflection point, even though the gross density continues to increase as additional NGL is added, the net density begins to reduce, along with a reducing phase transition pressure. The added NGL is taking up a larger and larger portion of the increase in gross density, leaving less room for the net gas.

In Recycle Trades, the net density is the key variable, such that this sharp inflection point will define the optimum quantity of added NGL. This feature is illustrated in FIGS. 2,3,4 and 5.

FIG. 2 shows the effect on net and gross gas density of varying levels of propane addition to the base gas, between 5% and 60% propane, as well as the density of the base gas mixture at both +60 degrees F. and −40 degrees F. without any NGL additive. While the gross density continues to increase with larger levels of propane addition, the net density reaches an inflection point at between 15% and 25% propane addition and a pressure of about 1100 psia. Above this amount of blended propane, the net density begins to reduce, along with a reduction in the phase transition pressure. As density is a surrogate for capacity, while pressure is a surrogate for cost, the minimum unit system cost in $/MCF will require a relationship between pressure and density to develop the optimum blend, as is apparent from the figures.

This cost/benefit relationship is shown in FIG. 3, where a relationship of 3:1 is assumed to apply between the cost of pressure and the benefit of density in a re-cycle ship-based transport system. That is, an increase of 30% in net density increases capacity by 30%, while an increase in pressure of 30% increases cost by 10%. With this economic relationship, FIG. 3 shows that the optimum amount of added propane is in the range of 15-25%. A similar result would occur with a 2:1 pressure:density relationship as well as a 4:1 relationship, which are also shown in FIG. 3.

FIG. 4 shows this same characteristic: for butane, where an optimum amount of added butane is in the 10-15% range. Again, it shows that the sharp inflection point is not that sensitive to the economic relationship between pressure and density.

FIG. 5 shows the same relationship for all four light NGL hydrocarbons, being ethane, propane, n-butane and n-pentane. Figures show that picking the inflection point and therefore the quantity of a particular NGL additive is fairly straightforward within a narrow range.

Choosing the type of NGL for blending is sensitive to the economic relationship between pressure and density and also the characteristics of the trade. There will be discrete pressure barriers that carry added cost implications, such as increasing the pressure beyond 1440 psia and the consequential requirements for more expensive ANSI 900 valves and fittings. The base gas will also contain some level of NGL, and the NGL recovery mechanism at the delivery end of a re-cycle trade will likely be indiscriminate between recovering indigenous NGL and added NGL. This implies that the NGL recovery mechanism will also influence the optimum type of NGL additive.

FIG. 6 illustrates the net density at the inflection point and the phase transition pressure for the NGL hydrocarbons ethane, propane, n-butane and n-pentane. It also illustrates the effect that combining two hydrocarbons in a mixed NGL blend (such as 50%/50% propane and butane by mole volume) will have on the net density. It also illustrates the net density of the base gas as compressed natural gas (CNG) at +60 degrees F. and −40 degrees F. so that the relative contribution to increasing density can be more readily separated into the temperature effect and the NGL additive effect.

Ethane blending implies an 830 psia system with a net density of 10.8 lb/CF. Propane blending implies a psia system with a net density of 13.7 lb/CF. N-Butane blending implies a 1305 psia system, with a net density of 15.0 lb/CF. N-Pentane blending implies a 1500 psia system with a net density of 15.8 lb/CF. N-Pentane blending takes the pressure regime beyond ANSI 600 limit and into the ANSI 900 range. The gross heat content of all of these optimum mixtures is within a range of 1330-1380.

For the n-butane blend, the density increases from 5.5 lb/CF for the base gas at +60 degrees F. and 1305 psia, to 11.5 lb/CF through the action of refrigerating the gas to −40 degrees F., an increase to 210% of the base gas. Adding 11% butane increases the net density to 15.04 lb/CF an increase to 273% of the base gas. At −40 degrees F. and 1305 psia, with the addition of 11% n-butane, the net density (excludes the added butane) of an 1112 BTU/CF natural gas is 318 times the density of the base gas at STP. The gross density (includes the added butane) is 445 times the density of the base gas at STP.

In FIG. 6, blends containing two adjacent hydrocarbons fall between the pure blends, in a fashion related to the average carbon number of the NGL blend. In fact, blends of several NGL hydrocarbons are seen to act in a similar fashion as a pure blend, based on the average carbon number. The 11% pure butane blend has a net density of 15.04 lb/CF at a transition pressure of 1305 psia. A 14% blend of a 50%/50% (by mole volume) propane/pentane additive has a net density of 14.93 lb/CF at a transition pressure of 1294 psia very similar to the pure butane case. A 12.5% blend of a 25%/50%/25% propane/butane/pentane additive has a net density of 15.01 lb/CF at a transition pressure of 1298 psia also similar to the pure butane case. Thus, an NGL (additive) blend with a similar carbon number as butane, operating at the inflection point and the phase transition pressure, will behave similar to pure butane.

This similarity also occurs if the components are isomers of the normal NGL, such as with iso-butane and normal butane, however both the net density and transition pressure are lower with isomers. An 11% blend of iso-butane has a net density of 14.42 lb/CF at a transition pressure of 1241 psia. The net density is 4.1% lower than with n-butane, while the transition pressure is 4.9% lower. At a 3:1 pressure:density economic relationship, the system prefers n-butane over iso-butane, however the difference is not that great so as to warrant any specific treatment of the isomers.

The same outcome occurs with blends of small amounts of heavier NGL, even up to decane or A blend of 17.5% propane and 82.5% base gas has a net density of 13.75 lb/CF at a transition pressure of 1088 psia. A blend that includes 3% octane (C8H18) and 97% of this propane/base gas mixture has a net base gas density of 14.12 lb/CF at a transition pressure of 1239 psia. This is between the values for a pure propane and a pure butane additive. A blend that includes 3% decane and 97% of the propane/base gas mixture has a gross density of 25.74 lb/ft3 and a net base gas density of 14.15 lb/CF at a transition pressure of 1333 psia.

The very heavy NGL components will still vaporize into a gas state at the phase transition pressure, so long as they are present in small quantities. This is an important feature for production from gas-condensate or rich gas reservoirs, where the liquids condense out of the gas as the pressure is lowered in the production process. If the decane were viewed as cargo, the net density is actually 18.35 lb/CF as compared to 14.15 lb/CF if the decane is recycled. On a 3000 MMCF ship, a 3% decane content translates into 131,000 Bbl of decane or about 40 Bbl per MMCF. This implies that rich gas reservoirs can potentially be produced directly into the system, without the need for extensive dual gas/liquids handling systems in the production process.

For preparation of vehicular fuels, this implies that the combining of natural gas, NGL and gasoline type heavy hydrocarbons, in some proportionate amount, can be used to create a very dense fuel in the dense single phase fluid state, which can have other desirable characteristics, such as octane or cetane number.

FIGS. 7(*a, b, c*) illustrate the choices for the optimum type of additive. For this particular illustration, the temperature is −40 degrees F. and the added NGL is assumed to be re-cycled. FIG. 7(*a*) shows the optimum at a 4:1 pressure:density economic relationship. FIG. 7(*b*) shows this at a 3:1 relationship. FIG. 7(*c*) shows this at a 2:1 relationship. The optimum occurs in a range of pressures from about 1100 psia to about 1450 psia, and a range of carbon counts of 3 (propane) and 4.5 (50%/50% butane/pentane). The basic pressure/density curve is fairly close to a 3:1 ratio over this range of carbon counts, such that choosing any of these mixtures would be very close to optimum. By reference to the very first example given in the above, that being an 86%/14% methane/butane mixture, the phase transition pressure was 1532 psia. By reference to the above 89% base gas/1% butane mixture, the phase transition pressure is 1305 psia. The reason for this difference is that the base gas contains some NGL components, 7.5% ethane and 3% propane.

Whether the NGL is indigenous to the base gas or is added through the use of this invention, the resulting physical parameters will be identical. Therefore, the 11% butane addition case (and a related carbon number of 4) should be placed in the context of an NGL component in the mixture that is actually 6.7% ethane, 2.7% propane and 11% butane. The average carbon number of the entire NGL component is actually 3.21. Thus, a 1305 psia phase transition pressure occurs with a mixture that has an average NGL carbon number (both indigenous and added) of about 3.2. Using the 7.5% pentane case on the base gas, a phase transition pressure occurs at 1500 psia for a mixture with an average carbon number of 3.8. The earlier example of an 86%/14% methane/butane mixture has an average carbon number of the total NGL of 4, therefore the phase transition pressure is higher, at 1532 psia.

In a Re-cycle Trade, the base gas will likely contain some NGL that will be recovered along with the added NGL, through a fractionation system at the delivery end, for recycle back to the supply end. This incremental NGL must be offloaded from the transport vehicle at some point in time, or else the NGL content would grow over time and the net density would reduce. In this fashion, regardless of the starting NGL additive, over time, the re-cycle NGL will approximate the composition of the NGL contained in the base gas only, as produced from the fractionation system. In this fashion, the fractionation system can be used to tune the recovery so that the optimum mixture is recycled (rather than having to be offloaded elsewhere). Recovery of propane plus is relatively low cost, while ethane recovery is relatively high cost. In addition, finding markets for the recovered NGL (assuming that incremental NGL is recovered on each cycle and must be disposed of) would be much more difficult if the NGL contained ethane due to its limited market potential. As most gas contains declining amounts of C3, C4, C5 and higher, an optimum blend of a carbon count of 3.5-4 can be achieved by recovering enough propane to offset the effect of heavier hydrocarbons in the final blend. Thus, if a carbon count of 4 was desired for the recycle NGL, and the base gas contained 4% propane, 2% butane and 1% pentane, the fractionation system would be tuned to recover 25% of the propane and all of the C4+. Controlling the level of propane recovery in a fractionation system is relatively straightforward and well understood by those skilled in the art.

It is possible that the delivered gas could be too high in heat content or WOBBE index (equal to the square root of the heat content divided by the specific gravity of the gas) to be integrated into the downstream delivery systems. In such situations, additional NGL recovery (propane in the above example) could be required at the fractionation plant, to deliver a gas with lower heat content, and this could result in a less than optimum NGL additive. In such a situation, the presence of carbon dioxide in the gas could have beneficial effects as it preferentially ends up in the delivered gas off the fractionation tower and it reduces the heat content and WOBBE index of the delivered gas.

The impact of the presence of carbon dioxide on net density of the gas mixture also shows certain advantages as illustrated in the following: A blend of 82.5% base gas and 17.5% propane has a net density of 13.75 lb/CF at 1088 psia. Blending 98% of this mixture with 2% carbon dioxide reduces the net density to 13.53 lb/CF but also reduces the transition pressure to 1072 psia. Thus, a 1.6% reduction in net density yields a 1.5% reduction in pressure. While not sufficient on its own to justify the 3:1 pressure:density economic relationship, together with the reduction in delivered gas heat content, it may in some circumstances be preferable to a system with no carbon dioxide.

Carbon dioxide also can be used to increase the net density of methane in much larger blending ratio applications where large volumes of carbon dioxide exist in the base gas. Adding 10% carbon dioxide to pure methane in a 90% methane and 10% carbon dioxide mixture has a net density (excluding the added carbon dioxide) of 7.37 lb/CF at a transition pressure of 1246 psia. Pure methane would have a density of 7.33 lb/CF at these conditions. Thus, the two are the same. A methane /carbon dioxide mixture has a net density of methane of 9.19 lb/CF at a transition pressure of 1053 psia. Pure methane has a density of 5.72 lb/CF at these conditions. Adding the carbon dioxide increases the net density of the methane to 160% of what it would otherwise be. A 60%/40% methane/carbon dioxide mixture has a net density of methane of 8.28 lb/CF at a transition pressure of 975 psia. Pure methane would have a density of 5.12 lb/CF at these conditions. This represents an increase in net density of 162% of what it would otherwise be. This feature would be of most economic benefit for systems where large volumes of carbon dioxide exist in the base gas, and where removal at the source would be expensive, and particularly if uses could be found for the carbon dioxide along the same trade route as the natural gas.

Unsaturated hydrocarbons such as propylene provide similar benefits as the saturated hydrocarbon of the same carbon number. For example, the base gas enriched with 17.5% propane has a net density of 13.75 lb/CF at a transition pressure of 1088 psia. Substituting propylene for propane in the mixture has almost no effect on the values. The net density is 13.74 lb/CF at a transition pressure of 1085 psia.

In an NGL Delivery Trade, the NGL additive will likely be based on the available supply of NGL, together with the available supply of base gas. In a system where the fuel is consumed during transit, the NGL additive could be a function of fuel specification, such as octane rating for automobiles. The above optimization calculations for net density will not be applicable, as the system will work over a wide range of conditions to handle the total volume of both gas and NGL to achieve the maximum bulk or gross density of the mixture at the lowest cost. Any amount of added NGL in such a system provides a benefit to the gross density of the mixture. If insufficient free NGL exists to achieve the desired composition, a portion of the NGL can be recycled to increase the density of the mixture.

FIG. 8 illustrates how the system capacity and pressure improves with lower temperatures than −40 degrees F. At lower temperatures, the economics of the system improve, as the net density increases and the phase transition pressure reduces. This is shown for the propane addition mixture, but would be similar for all mixtures. For each 5% reduction in temperature from 420 degrees R., the net density increases by about 10% and the phase transition pressure reduces by about 15%.

However, reducing the temperature will also increase the density of the base gas without any NGL addition. As methane has a critical temperature of −116.7 degrees F., as the temperature approaches this limit, the benefits of NGL addition reduce. It is possible to achieve the same density for the base gas without NGL addition as is achieved with the NGL addition, by operating the system without the NGL addition at a higher pressure than for the NGL enriched gas. One of the key economic aspects of the technology relates to how much of a pressure reduction is realized through the addition of NGL as compared to storing the base gas for transport at a similar temperature without NGL addition. This pressure saving is shown in FIG. 9.

FIG. 9 illustrates the pressure saving at different temperatures, for two gas compositions. The 1112 BTU/CF rich gas is shown (comparing it to a mixture containing 89% rich gas and 11% n-butane), along with a 1018 BTU/CF lean gas having a composition of 99% methane and 1% ethane (comparing it to a mixture containing 86% lean gas and 14% n-butane). The saving on pressure maximizes at about 420 psia and −40 degrees F. for the rich gas, and at about 550 psia and −80 degrees F. for the lean gas. The area where there is a saving on pressure for the rich gas occurs between −120 degrees F. and +100 degrees F., while the range for lean gas is slightly larger, from −140 degrees F. to +110 degrees F. This graph defines the temperature range over which the invention adds economic value.

Even though the invention is beneficial at temperatures above +30 degrees F., it is unlikely that a storage system embodying the invention will operate at higher temperatures than +30 degrees F. The large increase in net density and large reduction in phase transition pressure for small reductions in temperature imply that storage systems operating with some form of refrigeration will be the most obvious application for the invention. For this reason, the scope of the monopoly claimed in this disclosure of the invention is limited to gas temperatures below +30 degrees F., implying the need for refrigeration.

FIG. 10 is used in defining the pressure range over which the invention adds value. For the 11% n-butane enriched base gas and −40 degrees F., the net density at the phase transition pressure of 1305 psia is 15.04 lb/CF. Base gas without NGL addition would have to be stored at 1723 psia and −40 degrees F. to achieve the same density, a pressure saving of 418 psia. As the butane-enriched gas is almost non-compressible above the phase transition pressure, while the base gas is still quite compressible, the net density of the two compositions becomes the same at about 2000 psia. The savings on pressure reduces from 418 psia at the phase transition pressure to less than 50 psia above 150% of the phase transition pressure.

Therefore, above 150% of the phase transition pressure, the invention no longer adds significant value. Conversely, the net density of the butane-enriched gas drops off dramatically below the phase transition pressure, also shown in FIG. 10. At a pressure of about 1000 psia, or 75% of the phase transition pressure, the pressure savings again falls below 50 psia, and the invention no longer adds significant value. Thus, the invention adds value between 75% and 150% of the phase transition pressure.

While the actual values will be somewhat different for different compositions, similar features will be seen with all of the various blending compounds discussed herein.

In a transport system, this pressure saving will manifest itself in at least the following identifiable benefits:

- A smaller wall thickness for the container of a specific capacity, assumed in almost all cases be made of steel. This means less cost and weight and more competitive purchase options as more steel mills can manufacture the thinner walled steel container.
- Greater container diameter, as mills are usually limited by the wall thickness for a given diameter. This means fewer containers for a given capacity and this reduces the installation and manifold cost to connect the containers.
- Reduced ANSI rating for the valves and fittings. Typically, systems using this invention will use ANSI 600 valves and fittings (1440 psia) while CNG and higher pressured systems would use much higher and more costly ANSI rated fittings.
- Less weight means reduced fuel used to operate the transport system at a given speed.
- Lower pressure means a reduced compression requirement to prepare the gas for delivery to the container.
- Specifically for ships, less weight in the container means a higher ship height given the stability characteristics of the ship. This means more cargo.
- Specifically for ships, less weight means a lower ship draft, resulting in the ability to enter more ports.

FIG. 11 shows the shape of the decompression curve of the RNG system as the gas is unloaded at a delivery point. This can be used to provide additional benefits from the invention. This curve is non-linear and is shown for the 11% n-butane case.

The bulk density of the single dense phase fluid mixture at 1305 psia is 21.06 lb/CF The bulk density of the same mixture in a two-phase state at 650 psia is 5.47 lb/CF At 350 psia, the bulk density of the same mixture in a two-phase state is 2.41

Thus, 75% of the cargo can be unloaded at 50% of the pressure reduction and 89% of the cargo can be unloaded at 73% of the pressure reduction, assuming that a proportionate amount of liquid and vapor is unloaded at the same time.

As gas delivery systems located close to market areas typically operate at pressures in the 350-650 psia range, this can minimize the amount of compression required to unload the gas from the ship once the pressure on the ship falls below the market delivery pressure.

It is also fairly typical that gas production is available at higher pressures, close to the 1305 psia storage pressure. In this fashion, it can be seen that this system preserves useful pressure and minimizes the amount of power required to change the gas pressure purely for the purpose of transport.

Compressed natural gas systems use a lot of power to compress gas for storage, and then most of the useful pressure is discarded when delivered into the market. LNG discards the pressure when delivered into storage, and then must rebuild the pressure when delivering into the market. This system can be designed to operate at a pressure between the receipt pressure and the delivery pressure, thus discarding or wasting little pressure in the process of preparation for transport, loading and unloading.

The concept of methane or lean gas extraction to achieve the same results as the above is illustrated as follows:

- As it has particular application to gas which is produced from gas-condensate reservoirs or from gas that is produced in association with oil, a gas analysis was used from a gas-condensate reservoir in Peru. The raw gas contains 11294 BTU/CF with about 1.7% of the gas composed of C7+. On production of 1017.8 MMCFD, it is assumed that the 23,027 BPD of C7+ is extracted as oil, leaving 1000 MMCFD of gas at 1199.5 BTU/CF. If this gas is refrigerated to −70 degrees F., and put into a flash tank at 888 psia, a two-phase separation occurs. The vapor contains 50% mole volume or 500 MMCFD at a heat content of 1057.8 BTU/CF. While the vapor is mostly methane, there are small amounts of ethane and propane, thus the invention refers to removal of methane or a lean gas. The liquid contains 50% mole volume or 500 MMCFD at 1340.9 BTU/CF. The liquid off the flash tank can be pumped up to 1178 psia, and then warmed up to −40 degrees F. by heat exchanging with inlet gas, where it flashes into a vapor state. The phase transition pressure of this mixture is 1178 psia at −40 degrees F. and the density is 21.25 lb/CF. This dense single phase fluid can now be delivered to a ship and delivered to market without need of an NGL re-cycle. The C3-C6 component of this mixture represents 41,917 BPD of NGL that need not be re-cycled. The vapor off the flash tank can either be delivered back to the reservoir for injection for pressure maintenance, or can be delivered to an LNG plant for liquefaction and delivery to market. If one assumes that the vapor is required for pressure maintenance, the cold can be recovered by heat exchanging with the inlet gas. There is additionally a benefit in reducing the heat content of the injected gas into a reservoir for pressure maintenance. Assuming a reservoir condition of 150 degrees F. and 2130 psia, the Z factor of the 1199.5 BTU/CF raw gas is 0.801—with a density of 8.13 lb/CF The Z factor of the 1057.8 BTU/CF gas is 0.859 with a density of 6.59 lb/CF. Thus, a mass of lean gas equal to only 81% of the rich gas is required to preserve the same pressure, allowing for greater sales of gas during this pressure maintenance phase of the reservoir life. If one assumes that the residual gas can be sold as LNG, the cold vapor continues to go through additional refrigeration to become LNG. There is an overall system benefit in delivering a lean gas to the LNG plant, and the rich gas to the system described by this invention. The benefit of this system is that an additional large amount of mass can be delivered to market for the same cost, as the NGL is not re-cycled. The benefit on LNG arises because the liquefaction temperature of NGL is much higher than methane, for example ethane liquefies at −127 degrees F., while propane liquefies at −44 degrees F. Essentially, all the extra work done to refrigerate the NGL component of the gas to the −260 degree F. temperature is wasted, and could show better value refrigerating additional methane. In addition, there is an issue with LNG transport of roll-over, which tends to limit the amount of NGL in the system. Typically, the NGL component of LNG is separated at the source using fractionation and transported to market using LPG carriers.

The foregoing has illustrated certain specific embodiments of the invention, but other embodiments will be evident to those skilled in the art. Therefore it is intended that the scope of the invention not be limited by the embodiments described, but rather by the scope of the appended claims.

I claim:

1. A method for the storage of natural gas in a pressurized container for transport and the subsequent transport of said natural gas, said method comprising the refrigeration of natural gas below ambient temperature and the addition of C2+(all ethane and heavier hydrocarbons, including all isomers and both saturated and unsaturated compounds) at a temperature between −140 degrees F. and +30 degrees F. and at a pressure between 75% and 99.9% of the Phase Transition Pressure of the resulting gas mixture.

2. A method for the storage of natural gas in a pressurized container for transport and the subsequent transport of said natural gas, said method comprising the refrigeration of natural gas below ambient temperature and the addition of C2+(all ethane and heavier hydrocarbons, including all isomers and both saturated and unsaturated compounds) at a temperature between −140 degrees F. and +30 degrees F. and at a pressure between 98.5% and 99.5% of the Phase Transition Pressure of the resulting gas mixture.

3. A method for the storage of natural gas in a pressurized container for transport and the subsequent transport of said natural gas, said method comprising the refrigeration of natural gas below ambient temperature and the addition of C4+ and related hydrocarbons (hydrocarbons having 4 or more carbon molecules) at a temperature between −140 degrees F. and +30 degrees F. at a pressure between 75% and 99.9% of the Phase Transition Pressure of the resulting gas mixture.

4. A method for the storage of natural gas in a pressurized container for transport and the subsequent transport of said natural gas, said method comprising the refrigeration of natural gas below ambient temperature and the addition of C4+ and related hydrocarbons (hydrocarbons having 4 or more carbon molecules) at a temperature between −140 degrees F. and +30 degrees F. at a pressure between 98.5% and 99.5% of the Phase Transition Pressure of the resulting gas mixture.

5. A method for the storage of natural gas in a pressurized container and the subsequent transport of the natural gas and the container, said method comprising the refrigeration of natural gas below ambient temperature and the removal of methane or a lean gas from a richer natural gas, with said storage of the concentrated rich gas product at a temperature between −140 F. and +30 F. at a pressure between 75% and 99.9% of the Phase Transition Pressure of the resulting gas mixture.

6. A method for the storage of natural gas in a pressurized container and the subsequent transport of the natural gas and the container, said method comprising the refrigeration of natural gas below ambient temperature and the removal of methane or a lean gas from a richer natural gas, with said storage of the concentrated rich gas product at a temperature between −140 F. and +30 F. at a pressure between 98.5% and 99.5% of the Phase Transition Pressure of the resulting gas mixture.

* * * * *